US007479252B2

(12) United States Patent
Okada et al.

(10) Patent No.: US 7,479,252 B2
(45) Date of Patent: Jan. 20, 2009

(54) METHOD FOR MANUFACTURING THROWAWAY TIP AND APPARATUS FOR ALIGNING GREEN COMPACT

(75) Inventors: Yoshikazu Okada, Yuuki-gun (JP); Toru Narita, Yuuki-gun (JP); Shinsuke Fujisawa, Anpachi-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 73 days.

(21) Appl. No.: 10/810,491

(22) Filed: Mar. 26, 2004

(65) Prior Publication Data

US 2004/0202566 A1 Oct. 14, 2004

(30) Foreign Application Priority Data

Mar. 28, 2003 (JP) ..... 2003-092256
Mar. 28, 2003 (JP) ..... 2003-092257

(51) Int. Cl.
*B22F 3/12* (2006.01)

(52) U.S. Cl. ..... 419/38

(58) Field of Classification Search ..... 419/38; 425/78

See application file for complete search history.

(56) References Cited

U.S. PATENT DOCUMENTS 6,461,565 B2 * 10/2002 Tokuhara et al. ..... 419/38
6,464,931 B1 * 10/2002 Oota et al. ..... 266/274
6,537,488 B1 * 3/2003 Okumura et al. ..... 419/38
7,025,930 B2 * 4/2006 Okumura et al. ..... 419/38

FOREIGN PATENT DOCUMENTS

| | | |
|---|---|---|
| EP | 0555192 A1 | 8/1993 |
| JP | 5631532 | 3/1981 |
| JP | 61037399 | 2/1986 |
| JP | 03277701 | 12/1991 |
| JP | 09249902 | 9/1997 |
| JP | 10140210 | 5/1998 |
| JP | 2002003906 | 1/2002 |

OTHER PUBLICATIONS

"Sintered Hard Alloy and Sintering Hard Materials" by Hisashi Suzuki, Maruzen K. K., Japan, published on Feb. 20, 1986.
KJA Brookes, "Hardmetals and other Hard Materials", International Carbide Data, UK, 1992, pp. 19, 43.
KJA Brookes. "Hardmetals and other Hard Materials." International Carbide Data, U.K, 1992, pp. 19, 43, Dec. 1992.

(Continued)

*Primary Examiner*—Scott Kastler
(74) *Attorney, Agent, or Firm*—Darby & Darby P.C.

(57) ABSTRACT

A method for manufacturing a throwaway tip is presented in which a green compact Q obtained by press-forming raw material powder for the throwaway tip is placed and sintered on a sintering plate 8. The green compact Q is press-formed so that the density of the raw material powder is gradually decreased toward a predetermined direction R, and the direction R is oriented substantially toward the outer circumference of the sintering plate 8 in plan view. Thus, it is possible to obtain a throwaway tip having sintering accuracy.

25 Claims, 12 Drawing Sheets

OTHER PUBLICATIONS

World Directory and Handbook of Hardmetals and Hard Materials, Sixth Edition by Kenneth J A Brookes, published by International Carbide Data, 1975-1996, pp. 131-135, 157-159, Dec. 1996.

World Directory and Handbook of Hardmetals and Hard Materials, Fifth Edition, by Kenneth J A Brookes; published by International Carbide Data, 1975-1992, pp. 115-120, 145, Dec. 1992.

"Indexable inserts for cutting tools—Designation", JIS, B 4120 , pp. 1-12, Dec. 1998.

Turning Tools, Rotating Tools, Tooling Solutions, General Catalogue, C002E; A004-A005; A028-A029; C002-C003; C054-C055; C058-C059, 2005-2007, no date.

* cited by examiner

METHOD FOR MANUFACTURING THROWAWAY TIP AND APPARATUS FOR ALIGNING GREEN COMPACT

TECHNICAL FIELD OF THE INVENTION

The present invention relates to a method for manufacturing throwaway tips used as cutting edges of various cutting tools and an apparatus for aligning green compacts used with the method for manufacturing the throwaway tip.

This application claims priorities to Japanese Patent Application No. 2003-92256 and Japanese Patent Application No. 2003-92257, which were filed on Mar. 28, 2003, and which are incorporated herein by reference.

BACKGROUND OF THE INVENTION

Throwaway tips of this type are mainly made of sintered hard materials, such as cemented carbide manufactured according to the so-called powder metallurgy which forms a green compact by press-forming raw material powder, places the green compact on a sintering plate, and then receiving and heating the green compact in a sintering furnace to sinter the green compact. Here, in order to press-form a green compact from raw material powder as mentioned above, the die pressing method, which press-forms a green compact by compressing raw material powder filled into used from the viewpoint of process efficiency, as set forth on pages 18 and 19 in "Basis and applications of cemented carbide and sintered hard materials" issued on Feb. 20, 1986 by Suzuki Hishashi in Marujen Co., Ltd. In addition, a plurality of the green compacts formed as mentioned above are placed on one sintering plate in a direction conforming to its shape as compact as possible so that the maximum number of the green compacts may be received in the sintering furnace, and the green compacts are received and sintered in the sintering furnace with a plurality of such sintering plates being superposed.

By the way, as stated in the above literature, it is known that such powder metallurgy causes 15 to 22% of linear shrinkage in, for example, cemented carbide due to sintering of the green compact. Therefore, a dimension difference occurs between the green compact and the throwaway tip after sintering. Particularly in the die pressing method as mentioned above, if the density of the green compact is nonuniform during the press forming, large shrinkage deformation is generated at a portion of low density, which results in deterioration of dimensional accuracy of the sintered body. Conventionally, the above literature also exhibits there are researches for restricting such sintering deformation to the minimum by making the density of one green compact as uniform as possible. Practically, the deformation caused by sintering is restricted to a negligible level by making the dimension difference from the green compact to the throwaway tip after sintering uniform in one green compact as a whole. Incidentally, the conventional throwaway tip whose outer circumferential face (flank face) is made of a sintered skin becomes a so-called M-grade tip, and its dimensional accuracy has inscribed circle allowance of less than ±0.08 mm in a throwaway tip having an inscribed circle of 12.70 mm. If more dimensional accuracy is required, the outer circumference grinding is conducted to form a G-grade tip having an inscribed circle allowance of less than ±0.025 mm.

However, even in such a throwaway tip, there are recently more demands for higher accuracy without increasing its cost. For example, it is required to obtain approximately G-grade accuracy without performing the post-processing, such as the outer circumference grinding, to the throwaway tip which is sintered with a sintered skin as mentioned above. This means high degrees of sintering accuracy for the throwaway tip, which is a sintered product from the green compact. As a result, how to reduce the dimension error caused by the infinitesimal sintering deformation, which is not an issue in the conventional allowance, is now a significant subject.

The present invention has been achieved on the basis of such backgrounds. It is therefore an object of the present invention to provide a method for manufacturing a throwaway tip according to the powder metallurgy, which gives high sintering accuracy to satisfy approximately G-grade accuracy even for the throwaway tip in a sintered state, and to provide an apparatus for aligning of green compacts to the sintering plate, which is very suitable for using this method.

SUMMARY OF THE INVENTION

To achieve this object, the inventors of the present invention analyzed shrinkage deformation of a throwaway tip after sintering in detail, and found that there occurs infinitesimal deformation in each throwaway tip placed and sintered on the same sintering plate that a portion toward the outer circumference of the sintering plate in plan view, shows small shrinkage from the green compacts, whereas a portion toward the center of the inner circumference of the sintering plate shows increased shrinkage.

In other words, as shown in FIG. 12, the inventors has obtained a knowledge that infinitesimal deformation is generated in a way that, if a green compact Q having a dimension enlarged by only the linear shrinkage is sintered by press-forming a throwaway tip T having a desired dimension, a dimension difference S from the green compacts Q to the throwaway tip T after sintering is increased from the portion near the outer circumference of the sintering plate 21 (at an upper position in FIG. 12) to the portion near the inner circumferential center (at a lower position in FIG. 12) for each of green compacts Q, and an actual dimension of the throwaway tip T after sintering is relatively large at the portion toward the outer circumference of the sintering plate 21, as shown by reference numeral a in the drawing, while the actual dimension of the throwaway tip is decreased at the portion toward the inner circumference, as shown by reference numeral b in the drawing. Such deformation caused by difference in rate of shrinkage based on the orientations of the green compacts Q on the sintering plate 21 is negligible from the viewpoint of M-grade accuracy, but cannot be ignored to obtain approximately G-grade accuracy to the throwaway tip in a sintered state as mentioned above.

The present invention has been made on the basis of such knowledge, and provides a method for manufacturing a throwaway tip in which a green compact obtained by press-forming raw material powder for the throwaway tip is placed and sintered on a sintering plate, wherein, when the green compact is sintered isotropically and uniformly, the green compact is sintered so that a volume of deformation in a shrinking direction for a shape and dimension to be given to the throwaway tip after sintering is gradually increased in a predetermined direction, and wherein the green compact is placed on the sintering plate so that the predetermined direction is oriented substantially toward the outer circumference of the sintering plate in plan view.

In addition, the present invention provides an apparatus for aligning a green compact in which a green compact obtained by press-forming raw material powder for a throwaway tip is aligned and placed on a sintering plate, wherein the green compact is placed on the sintering plate so that a predetermined direction of the press-formed green compact is oriented substantially toward the outer circumference of the sintering plate in plan view.

In the case of manufacturing a throwaway tip according to above method in plan view, the green compact is infinitesimally deformed during sintering so that a portion toward the outer circumference of the sintering plate is less shrunken and a portion toward the inner circumferential center of the sintering plate is more shrunken, whereas, in the case of sintering the green compacts isotropically and uniformly, the green compact itself is formed so that a volume of deformation in the shrinking direction for the shape and dimension to be given to the throwaway tip after sintering is gradually increased in a predetermined direction. That is, in case the green compact is sintered so as not to generate inclination of the shrinkage deformation due to the orientation on the sintering plate as mentioned above, the portion of the green compact toward the predetermined direction is greatly deformed in the shrinking direction for the desired shape and dimension to be given to the throwaway tip after sintering, whereas the portion toward a direction opposite to the predetermined direction is deformed with a little volume of deformation in the shrinking direction for the desired shape and dimension. To speak in more detail, assuming that the shrinking direction on the basis of the desired shape and dimension to be given to the throwaway tip after sintering, that is, a direction toward the inner circumferential center of the throwaway tip or the green compact, is a positive direction, the green compact is formed in the predetermined direction so that the volume of deformation for the desired shape and dimension acting as a basis when sintered isotropically and uniformly is gradually increased from its opposite direction to the positive direction. Thus, by placing the green compact on the sintering plate so that the predetermined direction is substantially oriented toward the outer circumference of the sintering plate, that is, so that the predetermined direction in the aligning apparatus coincides with the predetermined direction in the manufacturing method, the deformation caused by difference in rate of shrinkage based on the orientation of the green compact on the sintering plate during sintering is offset by the difference of volume of deformations for the throwaway tip after sintering, oriented to the direction of the green compact itself. As a result, it is possible to obtain a throwaway tip having a desired shape and dimension with high accuracy in a sintered state. In addition, in order not to cause inclination in the shrinkage deformation according to the orientation on the sintering plate, that is, in order to sinter the green compact isotropically and uniformly so that partial difference in rate of shrinkage due to the orientation on the sintering plate is not generated, the green compact is placed on the sintering plate so that the center of the green compact coincides with the center of the sintering plate in plan view.

Here, if the green compact is sintered isotropically and uniformly as mentioned above, as a first means to form the green compact so that a volume of deformation in the shrinking direction for the shape and dimension to be given to the throwaway tip after sintering is gradually increased in a predetermined direction, the green compact is formed into a shape and dimension that a dimension difference between the green compact and the throwaway tip after sintering is gradually decreased in the predetermined direction.

By forming the green compact so that the dimension difference for the desired shape and dimension of the throwaway tip after sintering is gradually decreased in the predetermined direction, the green compact is formed so that a portion toward the predetermined direction is decreased rather than a portion toward its opposite direction on the basis of the size to be given to the throwaway tip after sintering, thereby making the portion toward the predetermined direction flat for the shape of the throwaway tip after sintering. On the contrary, the portion toward its opposite direction is spread, thereby making a non-similar configuration. If the green compact is sintered isotropically and uniformly so that partial difference in rate of shrinkage based on the orientation on the sintering plate is not generated, the green compact is uniformly shrunken while keeping the non-similar configuration, thereby increasing a volume of deformation from the predetermined direction to the shrinking direction for the shape and dimension to be given to the throwaway tip after sintering. Thus, if the green compact is placed and sintered on the sintering plate so that the predetermined direction is oriented substantially toward the outer circumference, the portion in the predetermined direction toward the outer circumference of the sintering plate shows a decreased rate of shrinkage, thereby reducing a rate that the volume of deformation is increased in the shrinking direction. On the contrary, the portion toward the inner circumferential center of the sintering plate in the opposite direction is shrunken with much volume of deformation, which is small volume of deformation in the shrinking direction. As a result, difference in rate of shrinkage due to the orientation on the sintering plate is offset, so it is possible to obtain a throwaway tip of a desired shape and dimension.

In addition, in the case of sintering the green compact isotropically and uniformly, as another means to form the green compact so that a volume of deformation in the shrinking direction for the shape and dimension to be given to the throwaway tip after sintering is gradually increased in a predetermined direction, the green compact is press-formed so that the density of the raw material powder is gradually decreased in a predetermined direction, and the green compact is placed on the sintering plate so that the predetermined direction is oriented substantially toward the outer circumference of the sintering plate in plan view.

In other words, the aforementioned literature has already revealed that, when the density of the press-formed green compacts formed is nonuniform, large shrinkage deformation is generated at a portion of low density. While the related art is dedicated to make the density of one green compact uniform, the present invention press-forms green compact in nonuniform density distribution intentionally so that the density of the green compact is gradually decreased in a predetermined direction, places the green compact so that the predetermined direction is oriented substantially toward the outer circumference of the sintering plate, and then sintering the green compact. Accordingly, the deformation caused by difference in rate of shrinkage based on the orientation of the green compact on the sintering plate is offset by the deformation caused by difference in rate of shrinkage based on the density gradient of the green compact, thereby making it possible to obtain a throwaway tip having a desired shape and dimension with high accuracy in a sintered state.

Here, as one means to press-form the green compact so that the density of the raw material powder is decreased toward in the predetermined direction, preferably, when the green compact is press-formed by filling the raw material powder into a cavity formed in a die, the filling quantity of the raw material powder into the cavity is controlled in the predetermined direction of the green compact after the press forming.

In other words, if the green compact is press-formed by controlling the filling quantity of the raw material powder, for example, filling the raw material powder so that the filling quantity of raw material powder is decreased in the predetermined direction, the density of the green compact is decreased where the filling quantity of the raw material is low. Thus, the green compact is placed on the sintering plate so that the predetermined direction in which the filling quantity of the raw material powder is decreased is oriented substantially toward the outer circumference of the sintering plate in plan view, thereby making it possible to offset the deformation caused by difference in rate of shrinkage based on the orientation of the green compacts on the sintering plate.

In addition, in order to control the filling quantity of the raw material powder into the cavity as mentioned above, preferably, a lower punch is provided in a cavity having an opening in the top face of the die so as to move vertically, and a raw material powder feed box is provided in the top face of the die so as to move across the top face. Thus, when the raw material powder feed box moves across the opening of the cavity, the lower punch can be moved vertically to supply the raw material powder from the raw material powder feed box, thereby controlling a filling depth of the raw material powder in the cavity.

As another means, in case the green compact is formed according to the aforementioned die pressing method, preferably, the raw material powder is filled into the cavity formed in the die so as to have an opening in the top face of the die, and an upper portion of the filled raw material powder is scraped, and the green compact is press-formed by selecting a direction opposite to the scraping direction as the predetermined direction, so that the opposite direction is oriented substantially toward the outer circumference of the sintering plate in plan view.

In other words, for example, in case raw material powder is supplied and filled from the raw material powder feed box movable along the top face of the die as mentioned above, the filled raw material powder is scraped while the raw material powder feed box for filling raw material powder into the cavity is moving across the opening of the cavity. At this time, the raw material powder in the vicinity of the opening of the cavity may be dragged and moved, for example, by a frictional force between raw material powders or between the raw material powder feed box and the raw material powder in a direction in which the powder feed box moves, i.e., the scraped direction, and as a result, the filling quantity of the raw material may be slightly increased in the scraped direction. Accordingly, in case the volume of deformation caused by difference in rate of shrinkage based on the density gradient of the press-formed green compact in a raw material filled state offsets the volume of deformation caused by difference in rate of shrinkage based on the orientation of the green compact on the sintering plate, a direction opposite to the scraped direction may become the predetermined direction. In addition, since characteristics of the raw material powder to be filled and the filling conditions affect on presence or absence of movement of the raw material powder in the scraped direction and its extent, it is also preferable to control an filling quantity of raw material in combination if an excess or deficiency is generated in the density gradient of the green compact in the raw-material filled state by the scraping.

On the other hand, in the present invention, the green compact is press-formed with a density gradient in which a density is gradually decreased in the predetermined direction and the green compact is placed on the sintering plate so that the predetermined direction is oriented substantially toward the outer circumference of the sintering plate. Thus, the throwaway tip after sintering is allowed to have a desired shape and dimension of high accuracy by offsetting the volume of deformation caused by difference in rate of shrinkage based on the orientation of the green compact on the sintering plate with the volume of deformation caused by difference in rate of shrinkage based on the density gradient of the green compact as mentioned above. In addition, by forming the green compact so that dimension difference of the throwaway tip after sintering is gradually decreased in the predetermined direction, it is possible to manufacture a throwaway tip of higher accuracy more reliably.

In other words, the shape and dimension itself of the green compact is formed so that the dimension difference between the green compact and the throwaway tip after sintering is gradually decreased in the predetermined direction, that is, a direction oriented substantially toward the outer circumference of the sintering plate with the green compact being placed on the sintering plate. Thus, the rate of shrinkage due to sintering is high at a portion oriented to the inner circumferential center of the sintering plate where the dimension difference of the green compact is increased, whereas the rate of shrinkage due to sintering is reduced at a portion oriented to the outer circumference of the sintering plate where the dimension difference is decreased. Thus, even though the sintering deformation is not sufficiently offset only by giving density gradient to the green compact, it is possible to manufacture a throwaway tip of a desired shape and dimension with higher accuracy more reliably.

In addition, as a first means to place the green compact formed as above on the sintering plate, for example, the aligning apparatus places a plurality of the green compacts on the sintering plate radially or concentrically in plan view.

As a result, the plurality of green compacts can be respectively aligned toward the outer circumference of the sintering plate in the relatively accurate predetermined direction, thereby making it possible to perform more precise sintering and forming. Here, in order to place a plurality of green compacts radially or concentrically, a big gap may be generated between adjacent green compacts according to the shape of the green compact, that is, the shape of the throwaway tip to be sintered, which results in decrease of the number of green compacts capable of being placed on one sintering plate. In this case, as another means, for example, the aligning apparatus places a plurality of the green compacts on the sintering plate in a lattice or zigzag shape in plan view, the plurality of green compacts placed on the sintering plate are divided into a plurality of green compact groups respectively extending from an inner circumferential center of the sintering plate to the outer circumference thereof in plan view, and the orientations of the green compacts in the same green compact group are made parallel so that the predetermined directions of the green compacts are oriented substantially toward the outer circumference of the sintering plate.

Moreover, the above aligning apparatus of the present invention includes a sintering plate holder for horizontally holding the sintering plate, and a conveyance mechanism for holding and conveying the green compact to be placed on the sintering plate, and the sintering plate holder has a rotation mechanism for positioning and rotating the sintering plate at each predetermined angle of rotation around its vertical axis. Thus, even in the case that a plurality of green compacts are radially or concentrically placed with the predetermined direction being oriented substantially toward the outer circumference, if the sintering plate is positioned and rotated at a predetermined angle of rotation by means of the rotation mechanism, the green compacts can be radially or concentrically aligned only by moving the green compacts in parallel by means of the conveyance mechanism without changing the direction (i.e., the predetermined direction). In addition, even in the case that the plurality of green compacts are divided into a plurality of green compact groups whose directions become parallel, and placed on the sintering plate in a lattice or zigzag shape in plan view, it is also possible to form a first green compact group in a lattice or zigzag shape by moving the green compacts in parallel without changing their direction by means of the conveyance mechanism, then positioning by rotating the sintering plate by a predetermined angle by means of the rotation mechanism, then forming a second green compact group in the same way, and then repeating these processes by the number of green compact groups, thereby aligning the green compacts in a lattice pattern or zigzag pattern composed of the plurality of green compact groups.

DETAILED DESCRIPTION OF THE INVENTION

Hereinafter, preferred embodiments of the present invention will be described referring to the accompanying drawings. However, the present invention is not limited to those embodiments, but, for example, elements of these embodiments may be appropriately combined with each other.

Figure 1:
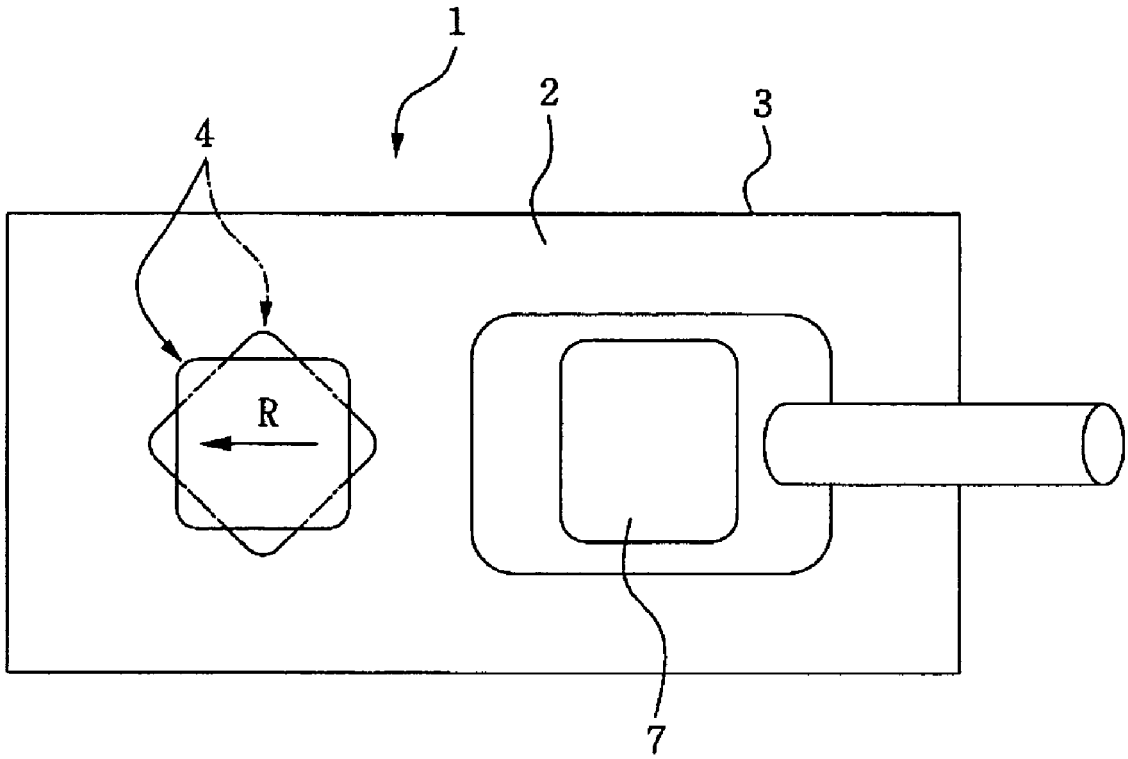
FIG. 1 is a plan view showing a die used with embodiments of the present invention.
Figure 2:
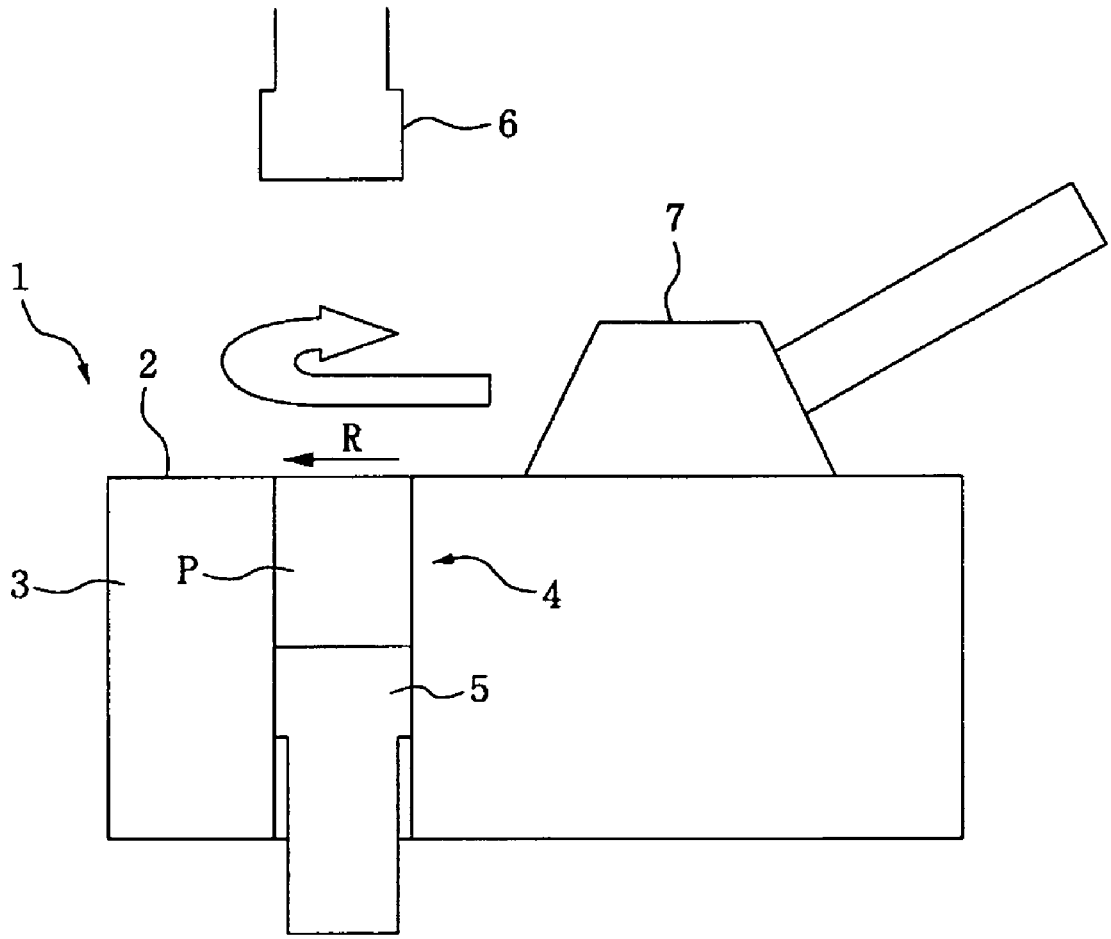
FIG. 2 is a side sectional view of the die 1 shown in FIG. 1.

FIGS. 1 and 2 show a die 1 used with this embodiment of the present invention. The die 1 has a die body 3 having a horizontal top face 2, a cavity 4 formed in the die body 3 and having an opening in the top face 2, a lower punch 5 provided in the cavity 4, an upper punch 6 provided right above the cavity 4 of the die body 3, the lower and upper punches 5 and 6 being movable vertically relative to the die body 3. On the other hand, on the top face 2 of the die body 3, a raw material powder feed box 7 for feeding raw material powder P such as cemented carbide supplied from a feeding means (not shown) to fill the raw material powder into the cavity 4 is provided so as to be capable of moving toward the opening of the cavity 4 as shown by an arrow in FIG. 2 while sliding on the top face 2. While the raw material powder feed box 7 is reciprocating, the raw material powder P is filled into the cavity 4, and then the upper and lower punches 5 and 6 are moved vertically relative to the die body 3 to compress the raw material powder P filled into the cavity 4, thereby press-forming a green compact Q.

In the embodiment of the present invention, if the raw material powder feed box 7 advances toward the cavity 4 (to the left in FIGS. 1 and 2) form a state shown in FIGS. 1 and 2 when the raw material powder feed box 7 is moved to fill the raw material powder P into the cavity 4, the raw material powder P supplied from the feeding means is filled into the cavity 4 through the raw material powder feed box 7. Then, when the raw material powder feed box 7 is retracted from the cavity 4 to return to a state shown in FIGS. 1 and 2, the raw material powder P is scraped to be flush with 2 of the die body 3 so that a predetermined amount (volume) of the raw material powder P substantially equal to the capacity of the cavity 4 is filled into the cavity 4.

Figure 3:
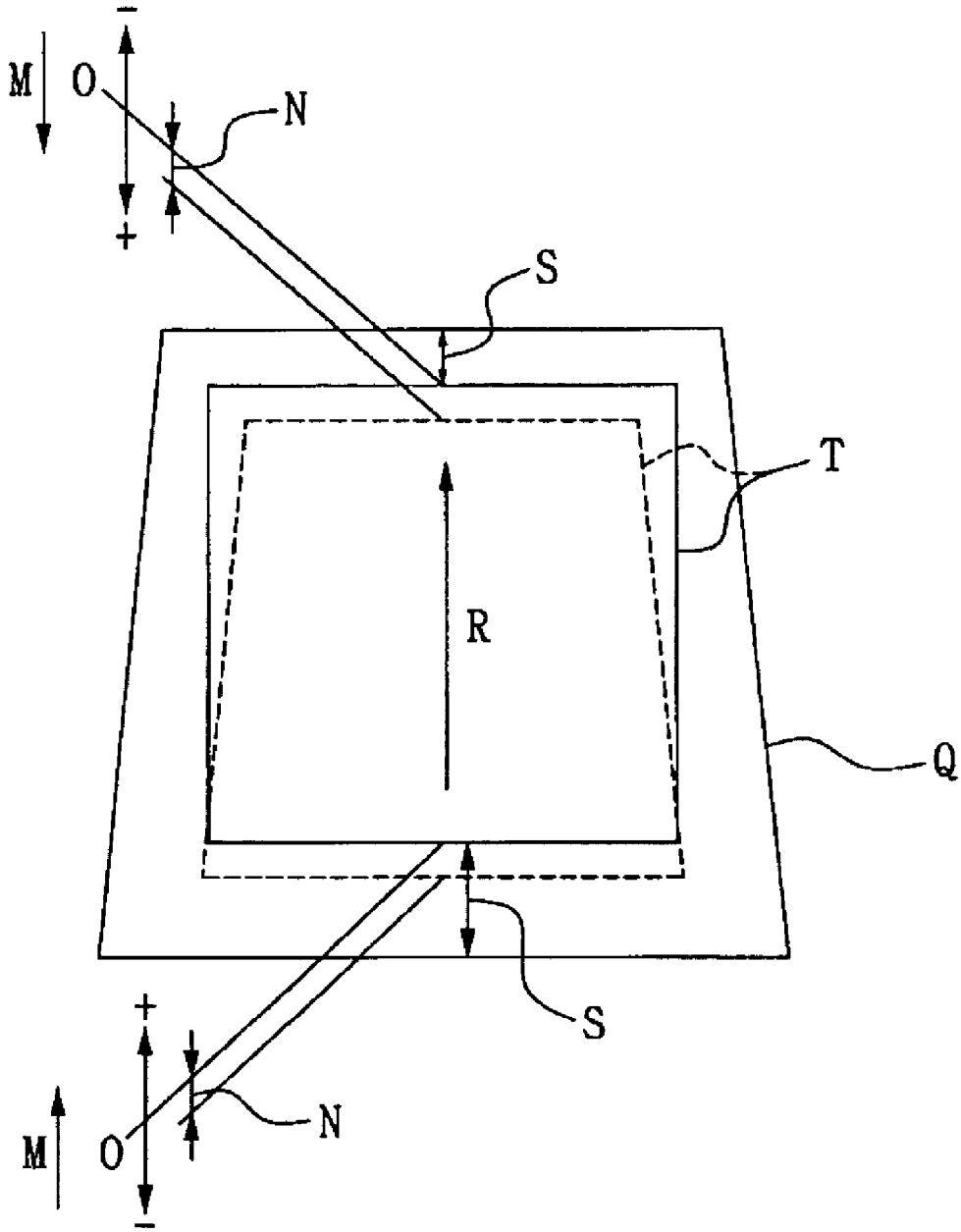
FIG. 3 is a plan view showing a green compact according to a first embodiment of the present invention and the shape and dimension of a throwaway tip after sintering in case the green compact is uniformly sintered.

In the first embodiment of the present invention, the press-formed green compact Q is formed into a shape and dimension that a dimension difference S between the green compact and the throwaway tip T after sintering is gradually decreased in a predetermined direction R, as shown in FIG. 3. Here, in the embodiment of the present invention, the direction R is vertically oriented from a side (a lower side in FIG. 3) of the square formed by the top face of the throwaway tip T to be sintered into a substantially square plate shape as mentioned above in plan view, toward another side (an upper side in FIG. 3) opposite to the side. Thus, the green compact Q is formed into substantially a plate shape of an isosceles trapezoid in which the other side in the direction R is shorter than the opposite side in plan view, not a square shape as in the case that the square formed by the throwaway tip T after sintering in plan view, is enlarged by isotropically considering the rate of shrinkage in sintering. Here, since the deformation of the throwaway tip T after sintering, caused by difference in rate of shrinkage based on the orientation of the green compact Q on the sintering plate, is extremely infinitesimal as mentioned above, length difference between two sides of the isosceles trapezoid formed by the green compact Q in plan view, is substantially very small, though it is shown bigger in FIG. 3 for the purpose of illustration.

In order to press-form the green compact Q forming an isosceles trapezoid in plan view, the shape itself in plan view, of the cavity 4 of the die 1 may be formed to have the isosceles trapezoid as mentioned above, as shown in FIG. 3. That is, in the first embodiment, since the predetermined direction R is a direction opposite to the scraping direction of the raw material powder feed box 7, the cavity 4 has a shape of isosceles trapezoid in which a side opposite to the scraping direction is shorter than its opposite side in plan view.

As mentioned above, the green compact Q press-formed by the die 1 is relatively lifted from the cavity 4 together with the upper punch 6 and the lower punch 5, and then moved out of the top face 2 of the die body 3, and then placed on the sintering plate and received into the sintering furnace for heating and sintering. At this time, if the green compact Q is isotropically and uniformly sintered so as not to generate difference in rate of shrinkage caused by the orientation of the green compact Q on the sintering plate, the throwaway tip T obtained as above is sintered into an isosceles trapezoid plate shape similar to the isosceles trapezoid shape formed by the green compact Q since the green compact Q is shrunken at a uniform rate of shrinkage as a whole. Thus, the desired shape and dimension to be given to the throwaway tip T after sintering, namely, a square shape in plan view, is deformed so that the volume of deformation N in the shrinking direction M is gradually increased in the predetermined direction R as shown by a dashed line in FIG. 3. Here, in the point that the shrinking direction M from the green compact Q to the throwaway tip when the green compact Q is sintered, namely a direction oriented from the outer circumference of the green compact Q or the throwaway tip T toward the inner circumferential center, is a positive direction (+), the volume of deformation N is positive (+) in the direction R in FIG. 3 (upward in FIG. 3) because the throwaway tip T (shown by a dashed line) sintered isotropically and uniformly is positioned toward the shrinking direction M (or, the inner circumferential center direction) with the throwaway tip T (shown by a solid line) of the desired shape and dimension as a basic O, whereas the volume of deformation N in the shrinking direction M is negative (−) in the opposite direction (downward in FIG. 3) on the basis of the throwaway tip T of a desired shape and dimension because the throwaway tip T (shown by a dashed line) sintered isotropically and uniformly is positioned in an opposite direction (or, the outer circumferential direction) to the shrinking direction M rather than the throwaway tip T (shown by a solid line) of the desired shape and dimension. Therefore, the volume of deformation N in the shrinking direction M is increased in the predetermined direction R. In addition, in order to isotropically and uniformly sinter the green compact Q at a uniform rate of shrinkage over the entire circumference thereof, for example, the center of the isosceles trapezoid formed by the green compact Q in plan view, is caused to coincide with the center of the sintering plate so that direction difference between the inner and outer circumferences is not generated for the green compact Q on the sintering plate.

Figure 4:
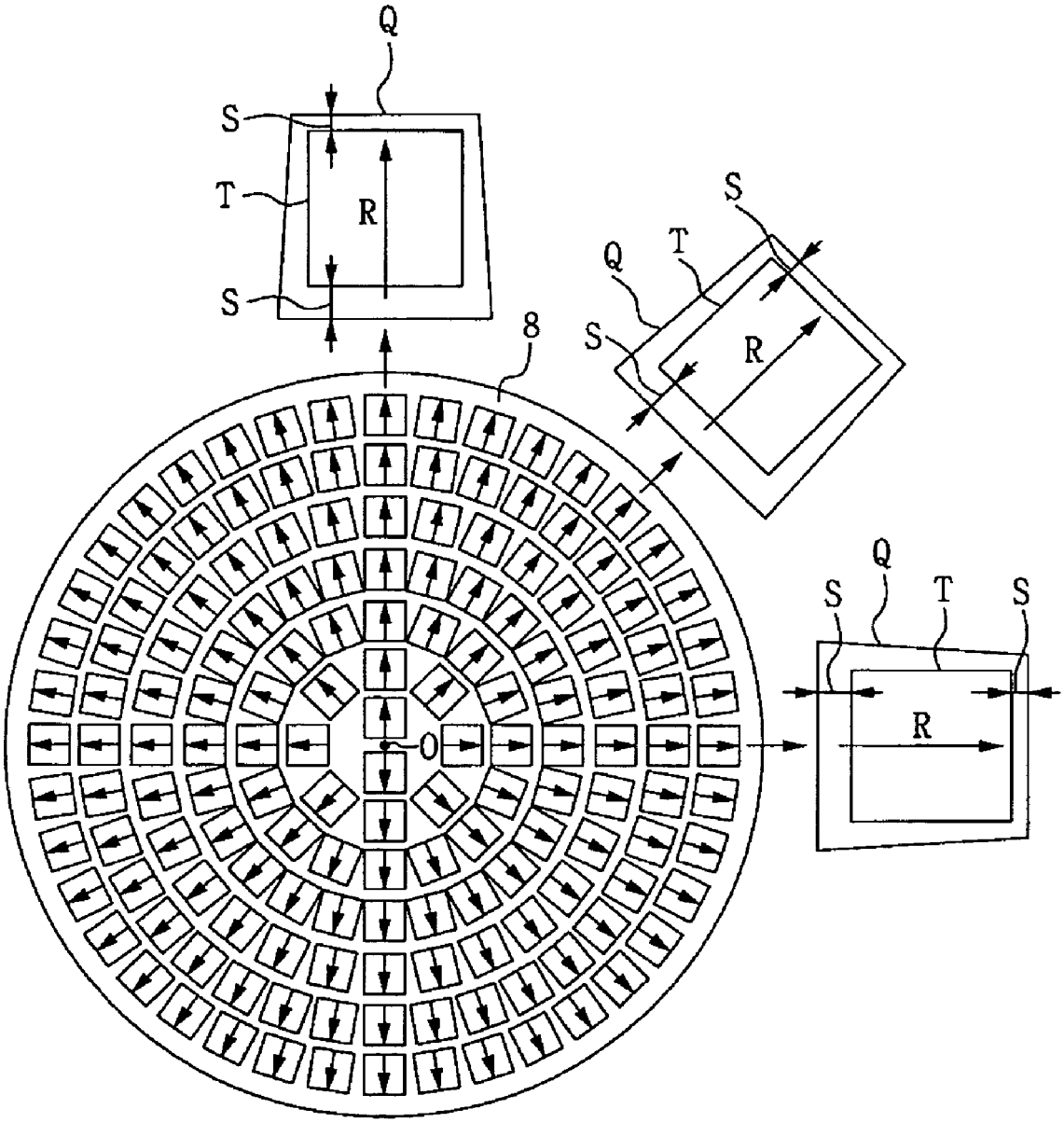
FIG. 4 is a plan view showing the arrangement of green compacts on a sintering plate according to a first embodiment of the present invention, and an enlarged plan view showing a dimension difference S between each green compact and the throwaway tip after sintering is decreased, using the arrow R outside the sintering plate.

In other words, when being placed on the sintering plate 8, the green compact Q is placed so that the direction R is oriented substantially toward the outer circumference of the sintering plate 8 in plan view, as shown in FIG. 4. Here, in this embodiment, the sintering plate 8 has a disc shape, a plurality of the green compacts Q . . . are arranged on such a sintering plate 8 to form a plurality of concentric circles about the center O of the circle of the sintering plate 8 in plan view, and then the plurality of green compacts Q are placed at suitable intervals so as not to contact each other, namely, at substantially regular intervals on each concentric circle in a circumferential direction and substantially at regular intervals between adjacent concentric circles in a radial direction about the center O. The green compacts Q . . . aligned as above are placed so that one side of the square formed by the upper and lower surfaces toward the scraping direction is orthogonal to a straight line passing through the center O toward the center O in plan view, thereby making the direction R oriented toward the outer circumference of the sintering plate 8 in its radial direction along the straight line. In addition, in this embodiment, it is also possible, instead of such a concentric alignment, to align a plurality of green compacts Q . . . , for example, along a plurality of straight lines passing through the center O at regular intervals in the circumferential direction so as to obtain a radial alignment or a concentric and radial alignment in plan view.

In addition, in order to place the plurality of green compacts Q . . . on the sintering plate 8, the present invention employs an aligning apparatus for aligning and placing the press-formed green compacts Q so that the direction R is oriented substantially toward the outer circumference of the sintering plate 8 in plan view, so as to gradually decreasing the density of the raw material powder P in the predetermined direction R.

Figure 5:
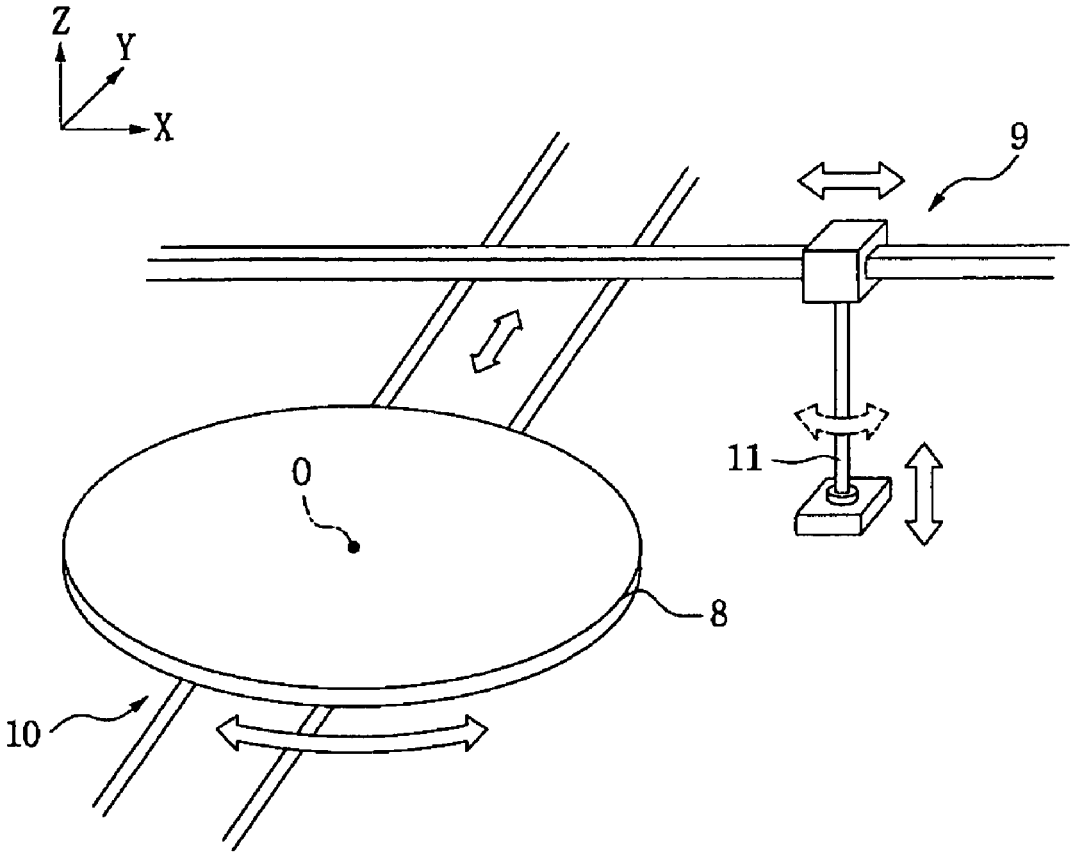
FIG. 5 is a schematic view showing an aligning apparatus of green compacts used with the embodiments of the present invention.

In other words, the aligning apparatus includes a conveyance mechanism 9 for conveying the green compact Q from the die 1 to the sintering plate 8, and a sintering plate holder 10 for horizontally holding the sintering plate 8, as schematically shown in FIG. 5. The sintering plate holder 10 has a rotation mechanism for positioning and rotating the held sintering plate 8 at each predetermined angle of rotation around the center O thereof. This rotation mechanism, for example, includes a rotation driving means, such as a motor, for rotating the sintering plate holder 10 around the center O, and a control means, such as a computer, for controlling the rotation driving means so that the sintering plate holder 10 is positioned and stopped at the predetermined angle of rotation which has been input in advance. In addition, the conveyance mechanism 9 includes a green compact holder 11 for detachably holding the green compacts Q by grasping or suction, and a moving means for moving the green compact holder 11 horizontally (X and Y directions in FIG. 5) and vertically (Z direction in FIG. 5) relative to the sintering plate 8.

By using such an aligning apparatus, for example, in case a plurality of green compacts Q . . . are concentrically arranged as mentioned above, a green compact Q press-formed in the die 1 is first lifted vertically with the green compact holder 11 held by the conveyance mechanism 9, is moved horizontally so as to be conveyed onto the sintering plate 8, is and is lowered vertically so as to be placed on the concentrical circles on which the corresponding green compacts Q are arranges, so that the direction R is oriented toward the outer circumference of the sintering plate 8, thereby releasing the holding by the green compact holder 11. Moreover, in this embodiment, the conveyance of the green compact Q by the conveyance mechanism 9 is parallel movement, that is, the direction R is not changed during the conveying process. Also, after placing the green compact Q on the sintering plate 8 and then releasing the holding, the green compact holder 11 is returned to the die 1 and then grasps and conveys the next green compact Q. During this process, the sintering plate 8 is rotated by a predetermined angle around the center O by means of the rotation mechanism, and then the next green compact Q is positioned, for example, at a position adjacent to the position occupied by the previously placed green compact Q and shifted with the suitable space therefrom in the circumferential direction. Thus, the next green compact Q is conveyed with a conveying trajectory identical to the previous green compact Q by means of the conveyance mechanism 9 so that the next green compact is placed on the position where the previous green compacts Q is placed before rotation so that the direction R is oriented toward the outer circumference. Therefore, by sequentially repeating this operation, a plurality of green compacts Q . . . is placed on the circumference of the same circle about the center O with the direction R being oriented toward the outer circumference. Further, by repeating this operation on other concentric circles with a space in the radial direction from the circle, the plurality of green compacts Q . . . may be concentrically placed on the sintering plate 8 in plan view, as shown in FIG. 4.

A plurality of the sintering plates 8 on which the green compacts Q . . . are placed as described above are superposed with a suitable interval, as necessary, and then received and heated in the sintering furnace so that the green compact Q . . . are sintered to form a throwaway tip. At this time, as for the manufacturing method, each green compact Q is press-formed with a density gradient of the raw material powder P decreased toward the predetermined direction R, and is placed on the sintering plate 8 so that the direction R is oriented toward the outer circumference of the sintering plate 8 in plan view, and infinitesimal deformation is generated during sintering so that shrinkage from the green compact Q to the throwaway tip is decreased toward the outer circumference of the sintering plate 8, that is, toward the direction R in plan view, as mentioned above. On the contrary, since the green compact Q itself is configured so that shrinkage is reduced toward the inner circumferential center of the sintering plate 8 opposite to the density gradient, or toward a direction opposite to the direction R, it is possible to offset the deformation caused by difference in rate of shrinkage based on the orientation of the green compact Q on the sintering plate 8 with the deformation caused by difference in rate of shrinkage based on the density gradient of the green compact Q itself. Thus, according to the method for manufacturing a throwaway tip configured as above, it is possible to correct the deformation caused by partial or fine difference in rate of shrinkage based on based on the orientation of the green compacts Q placed on the sintering plate 8. As a result, approximately G-grade accuracy may be obtained even in a tip having a sintered skin without being grinded after sintering. Therefore, the present invention makes it possible to manufacture a throwaway tip of a desired shape and dimension with high accuracy at a low cost.

In addition, in this embodiment, when the green compact Q is sintered isotropically and uniformly, in order to form the green compact Q so that the deformation degree N in the shrinking direction M is gradually increased in the predetermined direction R for the shape and dimension to be given to the throw-away tip T after sintering, the green compact Q is formed with a dimension shape that the dimension difference S between the green compact and the throwaway tip T after sintering is gradually decreased in the predetermined direction R. Thus, for example, if the die 1 for press-formed the green compact Q in such a dimension shape is provided, it is possible to form the green compact Q as mentioned above in the same process as the conventional die pressing method, thereby enabling manufacturing a throwaway tip with high accuracy according to the above manufacturing method without any special manipulation such as performing a post-process to the green compact after press-forming. Here, it is of course possible to form the green compact Q of the aforementioned shape and dimension by performing a post-process to the green compact after press forming.

Moreover, in this embodiment, even when the press-formed green compact Q is placed on the sintering plate 8, a plurality of the green compacts Q . . . having gradually decreased density in the direction R are radially or concentrically placed in plan view, and the green compacts Q arranged in a straight line radially extending from the center O of each concentric circle or the sintering plate 8 are arranged so that the direction R is oriented exactly toward the outer circumference of the sintering plate 8 and the direction R is radially extending from the center O toward the outer circumference in plan view of the sintering plate 8, as shown in FIG. 4. Therefore, according to this embodiment, since each green compact Q is placed so that the direction R is exactly oriented toward the outer circumference from the inner circumferential center O of the sintering plate 8, the deformation caused by difference in rate of shrinkage based on the orientation of the green compact Q on the sintering plate 8 may be more effectively offset by difference in rate of shrinkage based on the density gradient of the green compact Q, thereby allowing manufacturing a throwaway tip with higher accuracy. Moreover, since the sintering plate 8 has a disc shape in this embodiment, in order to place a plurality of the green compacts Q . . . on the sintering plate 8 radially or concentrically, it is sufficient to set straight lines extending radially from the center O or concentric circles about the center of the center O for the arrangement of the green compacts Q . . . on the basis of the center O of the disc of the sintering plate 8. In addition, an arrangement pattern of the green compacts Q . . . on the sintering plate 8 can be easily determined.

Furthermore, in the manufacturing method of this embodiment, in order to place the green compact Q on the sintering plate 8 in such an arrangement, an aligning apparatus for aligning and placing the green compacts Q, which are press-formed so that the density is gradually decreased in the predetermined direction R, on the sintering plate 8 so that the direction R is oriented substantially toward the outer circumference of the sintering plate 8 in plan view, is used and the plurality of green compacts Q . . . can be regularly placed on the sintering plate 8 with suitable intervals in the circumferential and radial directions. Also, in this embodiment, particularly, the aligning apparatus includes a conveyance mechanism 9 for conveying the green compact Q from the die 1 toward the sintering plate 8, and a sintering plate holder 10 for horizontally holding the sintering plate 8. The sintering plate holder 10 has a rotation mechanism capable of rotating and positioning the sintering plate 8 at a predetermined angle of rotation around the center O. Thus, the green compacts Q are sequentially placed on the sintering plate 8 while they are rotated and positioned on the sintering plate 8 at a predetermined angle by means of the rotation mechanism so that the green compacts Q can be held, conveyed, placed and returned to the die 1 in short cycles by only parallel movement in vertical and horizontal directions without changing their direction R. Therefore, even though the upper and lower punches 5 and 6 or the raw material powder feed box 7 is actuated at high speed in the die 1 to press-form the green compacts Q sequentially, the aligning apparatus can be synchronized with such rapid operation. As a result, the green compact Q may be rapidly placed on the sintering plate 8 without damaging the press-forming speed, ensuring efficiency in manufacturing a throwaway tip.

Here, the aligning apparatus may rotate the green compact holder 11 for holding the green compact Q around its vertical axis and position it at a predetermined angle of rotation as shown by a dashed line in FIG. 5, instead of, or together with, rotating the sintering plate 8 around its center O and positioning it at a predetermined angle of rotation. Thus, it is also possible to carry the green compact Q to sequentially place it at the predetermined position on the sintering plate 8 while changing the direction R. In addition, particularly in case the green compact Q is placed on the sintering plate 8 while it is rotated as mentioned above, the sintering plate holder 10 may be horizontally moved in at least one of X and Y directions for each sintering plate 8, and the conveyance mechanism 9 may be configured to move the green compact holder 11 in one (X direction in FIG. 5) of X and Y directions. Moreover, for example, an arm of an articulated robot may be provided with the green compact holder and may be programmed to arrange and place the green compacts Q on the sintering plate 8 as described above.

By the way, a plurality of green compacts Q . . . are radially or concentrically placed on the disc-shaped sintering plate 8 in plan view, in the first embodiment. However, if the same arrangement is adopted in the case of manufacturing a substantially square plate-shaped throwaway tip as in the first embodiment, the green compacts Q has a substantially square plate shape. Thus, an interval between the green compacts Q adjacent to each other in the circumferential direction as shown in FIG. 4 is gradually increased toward the outer circumference so that the number of green compacts Q . . . capable of being placed on the same sintering plate 8 is restricted. Thus, it is impossible to receive and sinter the more number of green compacts Q . . . in the sintering furnace at one time, which may deteriorate efficiency in making a throwaway tip. This tendency is more remarkable when the green compacts Q . . . are placed and sintered on a rectangular sintering plate, rather than on the disc-shaped sintering plate 8. In addition, in case the aligning apparatus described above is used for aligning the green compacts Q on the sintering plate 8, if the arrangement of the green compacts Q has a shape of radial or concentric circles, the green compacts Q . . . should be sequentially placed on the sintering plate 8 while they are rotated and positioned on the sintering plate 8 at a smaller angle of rotation between the green compacts Q adjacent to each other in the circumferential direction, which may complicate control of the rotation driving means by the control means in the rotation mechanism of the aligning apparatus.

Figure 6:
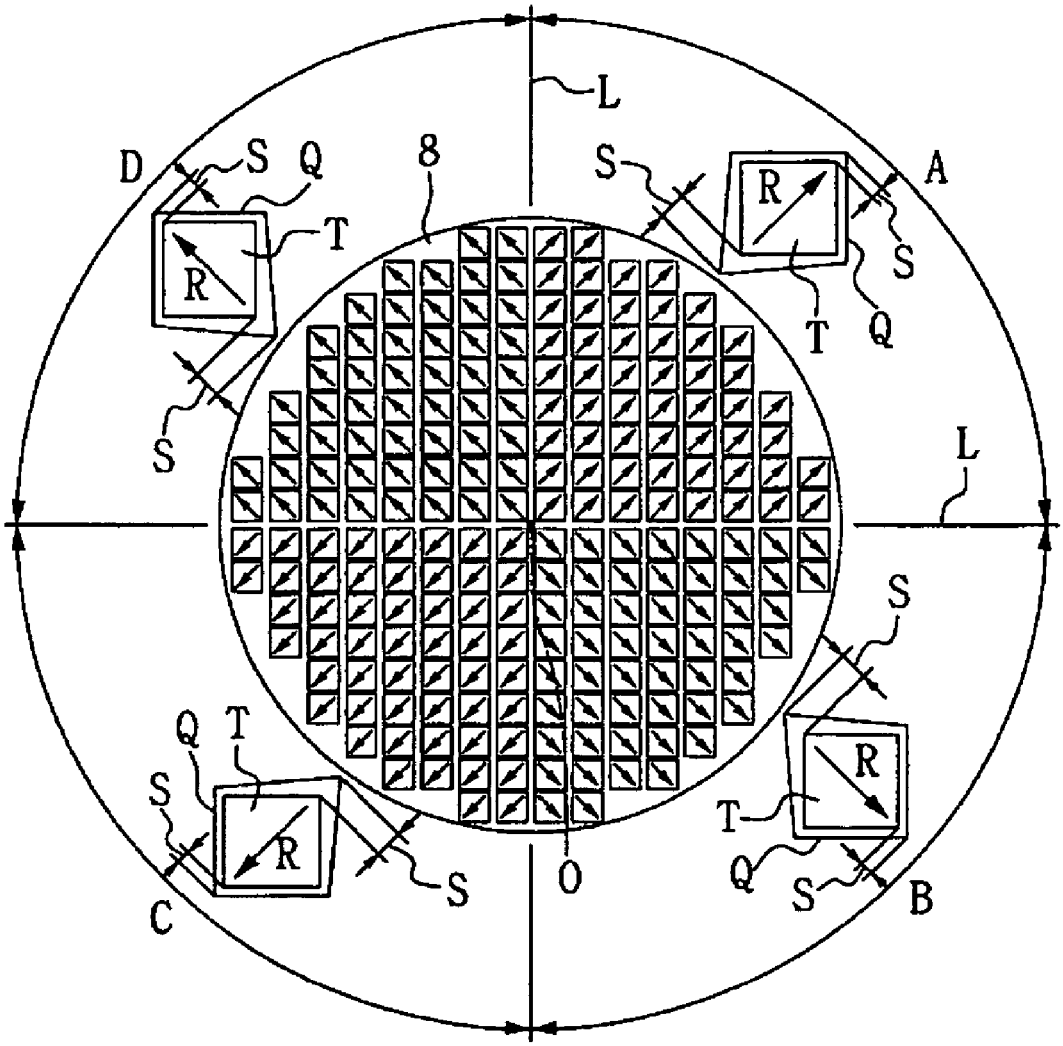
FIG. 6 is a plan view showing the arrangement of green compacts on a sintering plate according to a second embodiment of the present invention, and an enlarged plan view showing a dimension difference S between each green compact composing green compact groups A to D and the throwaway tip after sintering is decreased, using the arrow R outside the sintering plate.
Figure 7:
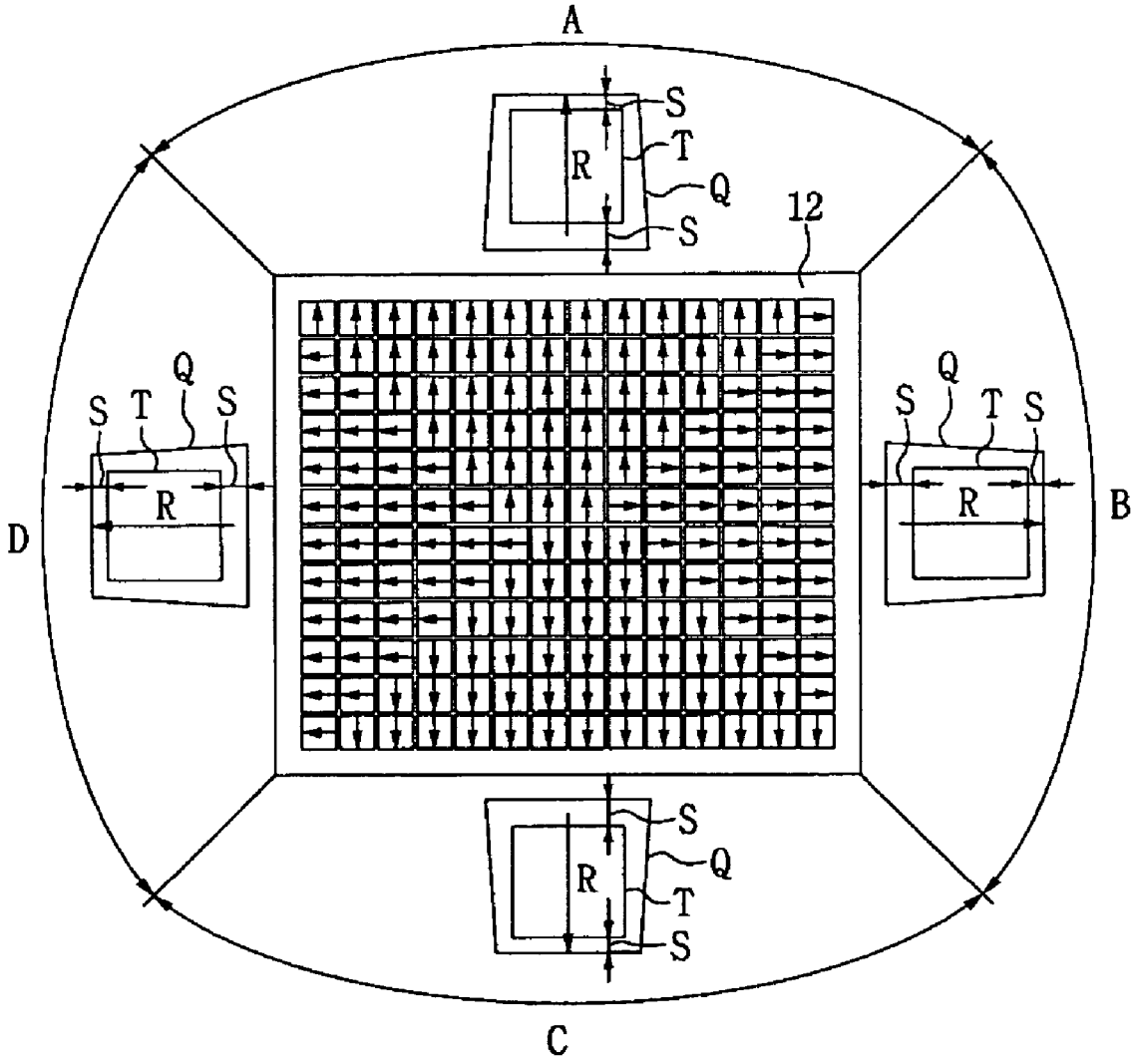
FIG. 7 is a plan view showing the arrangement of green compacts on a sintering plate according to a third embodiment of the present invention, and an enlarged plan view showing a dimension difference S between each green compact composing green compact groups A to D and the throwaway tip after sintering is decreased, using the arrow R outside the sintering plate.

In that case, the plurality of green compacts Q . . . are placed on the sintering plates 8 and 12 in a lattice or zigzag pattern in plan view, as in a second embodiment shown in FIG. 6 or a third embodiment shown in FIG. 7, and then the plurality of green compacts Q . . . are divided into a plurality of green compact groups A to D (four groups in the second and third embodiments) respectively extending from the inner circumferential center to the outer circumference of the sintering plates 8 and 12 in plan view so that the directions R of the green compacts Q in the same green compact groups A to D are made parallel. Thus, the green compacts Q may be placed so that the direction R in which the density of each green compact Q is decreased is oriented substantially toward the outer circumference of the sintering plates 8 and 12. In addition, the second embodiment shows that the sintering plate 8 has the disc shape as that in the first embodiment, while the third embodiment shows that the sintering plate 12 has a rectangular plate shape.

Among them, in the second embodiment, as described above, the green compacts Q . . . press-formed in a substantially square plate shape, similar to that in the first embodiment, are placed on the sintering plate 8 having the same disc shape as that in the first embodiment, in a lattice pattern so that each side of the square formed by the upper and lower surfaces of the green compact is parallel to a pair of diametrical lines L and L orthogonal to each other at the center O of the disc formed by the sintering plate 8, or so as to have regular intervals in directions of the diametrical lines L and L. Also, the plurality of green compact groups A to D are composed of the green compacts Q . . . respectively placed on four sectors extending from the center O toward the outer circumference and divided by these diametrical lines L and L, and the green compacts Q in each green compact group A to D are arranged so that the directions R of the green compacts Q are made parallel to each other and are oriented substantially toward the outer circumference of the sintering plate 8.

Further, in the second embodiment, the predetermined direction R in which the dimension difference S between the green compact and the throwaway tip T after sintering is decreased is not a direction from one side of the top face of the green compact Q toward the other side vertically opposite thereto as in the first embodiment, but a direction oriented from one corner of the square toward an opposite corner along a diagonal line passing through the corner, as in the green compact Q enlarged in such a manner to correspond to the respective green compact groups A to D outside the sintering plate 8 in FIG. 6. Thus, the green compact Q of the second embodiment is formed so that a corner toward the direction R has an obtuse angle and the opposite corner has an acute angle in plan view, thereby forming a shape of inclined quadrangle that is symmetrical with respect to the diagonal lines connecting these corners. However, the inclination of the inclined quadrangle formed by the green compact Q in plan view, is actually extremely infinitesimal. Also, the directions R of all green compacts Q . . . composing the same green compact groups A to D divided by the pair of diametrical lines L and L interposed between the sectors of the green compact groups A to D are all made parallel.

Further, in order to press-form the green compacts Q having density gradients in the diagonal direction R of the square formed by the upper and lower surfaces with the use of the die 1 as shown in FIGS. 1 and 2, as shown by a dashed line in FIG. 1 for example, the cavity 4 itself formed in the die body 3 is formed so that the diagonal line of the square in plan view of the green compact Q to be press-formed conforms to the scraping direction of the raw material powder feed box 7, and the predetermined direction R becomes a direction oriented opposite to the scraping direction along the diagonal line. In other case, instead of or together with the fact, the filling quantity of the raw material powder P into the cavity 4 is controlled in a direction, which will be selected as the predetermined direction R, so that the green compacts Q of the respective green compact groups A to D are placed on the sintering plate 8 with the predetermined direction R being oriented substantially toward the outer circumference of the sintering plate 8. Moreover, in second embodiment, the arrangement of the green compacts Q . . . in the respective green compact groups A to D is rotatably symmetrical by an included angle (90° in this embodiment) formed by the diametrical lines L and L adjacent to each other in the circumferential direction about the center O. In other words, when the sintering plate 8 is rotated by the included angle about the center O, arrangement and direction R of the green compacts Q . . . in the respective green compact groups A to D become coincided.

In addition, in the third embodiment shown in FIG. 7, as mentioned above, a plurality of green compacts Q . . . having a square plate shape are arranged on the sintering plate 12 having a rectangular plate shape in a lattice pattern at regular intervals in long and short side directions so that each side of the square forming the upper and lower surfaces is parallel to long and short sides of the rectangle formed by the sintering plate 12 in plan view. The green compacts Q . . . are substantially divided by a pair of diagonal lines of the rectangle formed by the sintering plate 12, thereby forming a plurality of green compact groups A to D (four groups in this embodiment) having a substantially isosceles triangle respectively extending from the inner circumferential center of the sintering plate 12 toward the outer circumference thereof in plan view. Here, the division of these green compact groups A to D does not strictly obey the diagonal lines of the rectangle formed by the sintering plate 12, but corresponds to the isosceles triangles, substantially divided by the diagonal lines, whose base line is the long or short side of the rectangle, as shown in FIG. 7. Also, in this embodiment, the green compact Q is configured so that a direction oriented from a side of the square formed by their upper and lower surfaces in plan view, toward opposite side perpendicularly opposite to the side is the predetermined direction R, with a density gradient that density is gradually decreased in the direction R, similar to the first embodiment. The green compacts Q are placed so that the directions R in the respective green compact groups A to D are parallel to a direction oriented toward the outer circumference of the sintering plate 12, perpendicular to the base line of the isosceles triangle formed by the corresponding green compact groups A to D, that is, perpendicular to the long and short sides of the rectangle formed by the sintering plate 12, as in the green compacts Q enlarged in such a manner to correspond to each green compact group A to D outside the sintering plate 12 in FIG. 7.

In the second and third embodiments configured as above, in case the green compact Q is placed so as not to generate partial difference in rate of shrinkage due to the orientation on the sintering plates 8 and 12, namely, with its center being caused to coincide with the center O of the sintering plates 8 and 12 so that it may be sintered isotropically and uniformly, the green compact Q is shrunken in a similar shape while keeping its shape in plan view of the green compact Q. Thus, in the second embodiment, the green compact is formed into an inclined quadrangle shape in that the volume of deformation N in the shrinking direction M for the shape and dimension to be given to the throwaway tip T after sintering is gradually increased toward the direction R, and the third embodiment also forms the same isosceles trapezoid shape. Also, if the green compacts Q having such a shape are placed and sintered on the sintering plates 8 and 12 in a lattice pattern so that the directions R are parallel to each other in the respective green compact groups A to D so as to be oriented substantially toward the outer circumference of the sintering plates 8 and 12, the deformation caused by difference in rate of shrinkage due to the orientation of the green compact Q on the sintering plates 8 and 12 can be offset, thereby allowing manufacturing a throwaway tip with high accuracy.

Also, since the plurality of green compacts Q . . . are placed on the sintering plates 8 and 12 in a lattice pattern in the second and third embodiments, it is possible to prevent that adjacent green compacts Q are spaced apart more than required, thereby allowing densely arranging the green compacts Q on the sintering plates 8 and 12. In other words, the number of green compacts Q capable of being placed on one sintering plate 8 and 12 can be increased, and the efficiency of manufacturing a throwaway tip can be improved by receiving and sintering the more number of green compacts Q in the sintering furnace at one time. In addition, the plurality of green compacts Q . . . is arranged in series for both lateral and longitudinal directions in plan view, in the second and third embodiments so that the green compacts Q have a lattice pattern. However, the green compacts Q may be arranged in a zigzag pattern by placing green compacts Q between two adjacent rows (either lateral or longitudinal) aside in a direction in which the row extends.

Further, even when the plurality of green compacts Q . . . are divided into a plurality of green compact groups A to D with the directions R being parallel to each other and then arranged on the sintering plates 8 and 12 in a lattice or zigzag pattern as in the second and third embodiments, the aligning apparatus used in the first embodiment may be adopted. In other words, in order to form the plurality of green compact groups A to D linearly extending from the center O of the sintering plate 8 toward the outer circumference by placing the plurality of green compacts Q . . . on the sintering plate 8 having a disc shape in a lattice pattern so that the directions R are parallel to each other as in the second embodiment, the sintering plate 8 is first positioned, and then the green compacts Q are sequentially conveyed by the conveyance mechanism 9 from the die 1 without changing the directions R so as to be placed on a portion surrounded by the diametrical lines L and L of the sintering plate 8 in a lattice pattern. Thus, the first green compact group A composed of a plurality of green compacts Q with the directions R being parallel to each other is formed, and the sintering plate 8 is rotated by a predetermined angle (90° in the second embodiment) around the center O and positioned by means of the rotation mechanism, and the green compacts Q are sequentially conveyed and placed on the sintering plate 8 in a lattice pattern in the same way, and then the second green compact group B is formed in the same way. Similarly, such processes are repeated to form the third and fourth green compact groups C and D. Here, since the arrangement of the green compacts Q in the respective green compact groups A to D becomes rotatably symmetrical by 90° around the center O in the second embodiment, the green compacts Q may be placed in the same arrangement pattern when forming the respective green compact groups A to D. In addition, in the third embodiment, though the green compact groups A and C have an arrangement pattern different from the green compact groups B and D, the green compacts Q . . . are placed in a lattice pattern with the directions R being parallel to each other as in the second embodiment while the sintering plate 12 of a rectangular plate shape is rotated and positioned by a predetermined angle (90° in the third embodiment) around the center where the diagonal lines of the rectangle are crossed, so as to place the green compacts Q . . . of the green compact group A in a lattice pattern with the directions R being parallel to each other, thereby forming the green compact groups A to D sequentially.

Next, fourth to sixth embodiments of the present invention will be described in which only a density gradient is given to a green compact when the green compact is press-formed according to the aforementioned die pressing method, and then the formed green compact is placed and sintered on a sintering plate so that a negative throwaway tip having a substantially square plate shape is manufactured. In these embodiments, the green compact Q is placed on the same sintering plates 8 and 12 as the first to third embodiments in the same direction R and the same arrangement pattern, and then the same throwaway tip T having a substantially square plate shape is manufactured. The elements common to those in the first to third embodiments are designated by the same reference numerals, and the description thereof is simplified.

In order to scrape the raw material powder P filled into the cavity 4 using the die 1 shown in FIGS. 1 and 2, the raw material powder P in the vicinity of the opening of the cavity 4 is dragged in the scraping direction (to the right in FIGS. 1 and 2) toward which the raw material powder feed box 7 is retracted, due to a frictional force between the raw material powders P or between the raw material powder feed box 7 and the raw material powder P according to characteristics of the raw material powder P or filling conditions of a raw material. Thus, the density of the raw material powder P in the cavity 4 in the scraping direction becomes slightly larger than that in the direction opposite to the scraping direction. In other words, a density gradient is generated that gradually increases the density of the raw material powder P in the direction opposite to the scraping direction, thereby making the density distribution nonuniform.

However, conventional research is dedicated to preventing such nonuniform density distribution as mentioned above. In the fourth to sixth embodiments, the raw material powder having such a density gradient is compressed in the cavity 4 as it is by vertically moving the upper and lower punches 5 and 6 so that they approaches each other, and the green compact Q having a gradually decreased density in a predetermined direction shown by reference numeral R in the drawing is press-formed. Therefore, in this embodiment, the predetermined direction R becomes a direction opposite to the scraping direction.

Moreover, in this embodiment, since the reciprocating direction of the raw material powder feed box 7 is parallel to two opposite sides of the square of the cavity 4 as mentioned above, the direction R of the green compact Q becomes parallel to the two sides of the square formed by the upper and lower surfaces of the green compact Q, and is oriented from one side of the remaining two sides in the scraping direction to its opposite side. Instead of or together with selecting a direction opposite to the scraping direction of the raw material powder P as the predetermined direction R, it is also possible to control the filling quantity of the raw material powder P (or, the filling quantity of a raw material) into the cavity 4 in the predetermined direction R by supplying and filling the raw material powder P from the raw material powder feed box 7 into the cavity 4 by vertically moving the lower punch 5 while the raw material powder feed box 7 is moving across the opening of the cavity 4, and then press-form the green compact Q so that the density of the raw material powder P is gradually decreased in the predetermined direction R. In other words, if the lower punch 5 is gradually lowered relative to the die body 3 when the raw material powder feed box 7 is retracted on the top face 2 of the die body 3 in the scraping direction, the filling depth of the raw material powder P is gradually increased as the raw material powder feed box 7 moves toward the scraping direction and the filling quantity of a raw material is controlled to decrease toward the predetermined direction R opposite to the scraping direction. Therefore, by press-forming the filled raw material powder as it is, it is possible to obtain the green compact Q whose density is gradually decreased toward the predetermined direction R.

Figure 8:
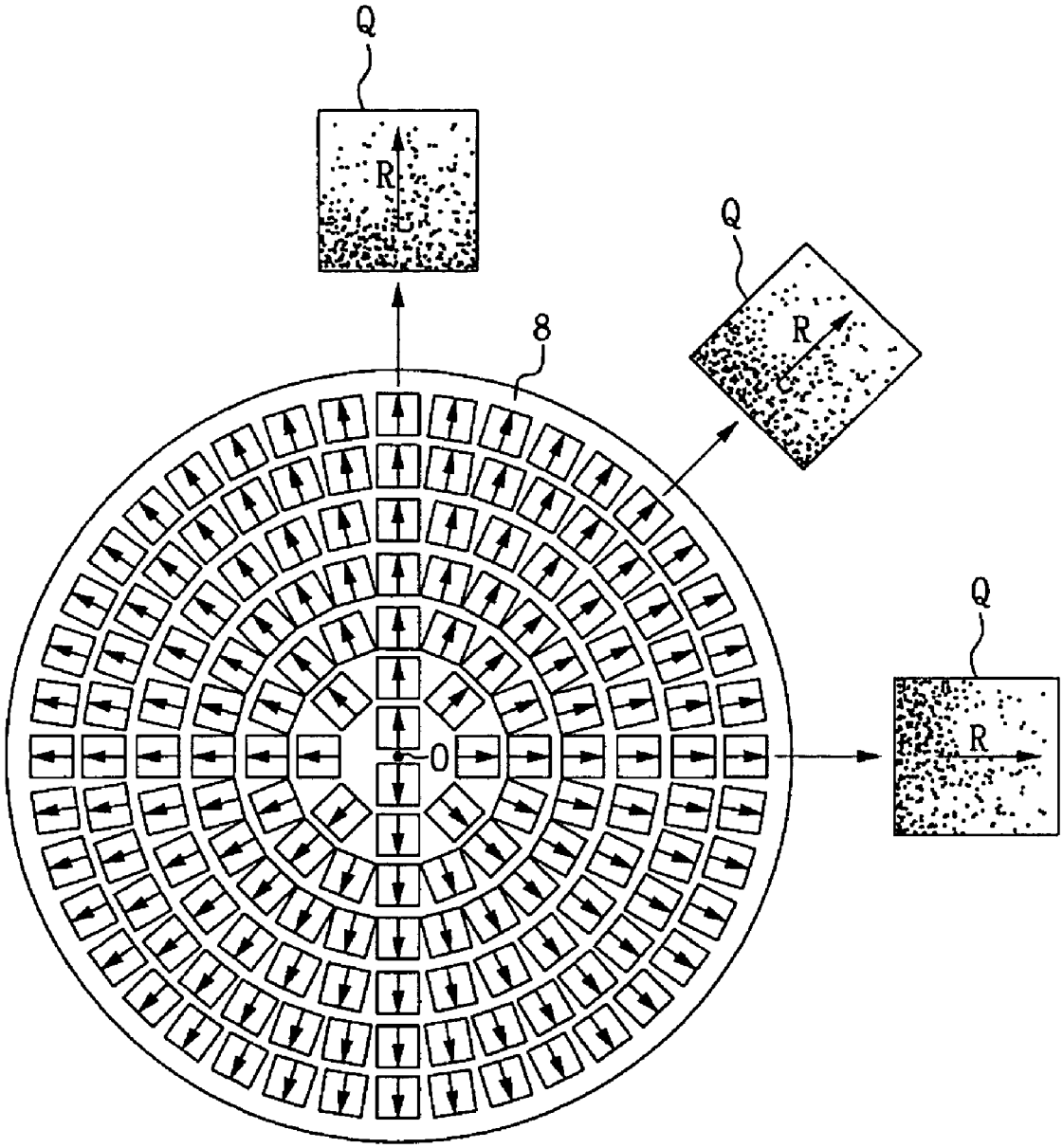
FIG. 8 is a plan view showing the arrangement of green compacts on a sintering plate according to the fourth embodiment of the present invention, and an enlarged plan view showing a direction in which the density of each green compact is decreased, using the arrow R outside the sintering plate.

The green compact Q press-formed by the die 1 as mentioned above is relatively lifted from the cavity 4 together with the upper and lower punches 6 and 5, and then pulled out of the top face 2 of the die body 3, then received in the sintering furnace while placed on the sintering plate, and then heated for sintering. In the fourth embodiment similar to the first embodiment, as shown in FIG. 8, the green compacts Q are concentrically placed on the sintering plate 8 toward the outer circumference of the sintering plate 8 so that the directions R are oriented toward the outer circumference of the sintering plate 8 in plan view. Also, the green compacts Q are placed at suitable intervals so as not to contact each other, namely, at substantially regular intervals on each concentric circle in a circumferential direction and substantially at regular intervals between adjacent concentric circles in a radial direction about the center O. The green compacts Q . . . aligned as above are placed so that one side of the square formed by the upper and lower surfaces toward the scraping direction is orthogonal to a straight line passing through the center O toward the center O in plan view, thereby making the direction R oriented toward the outer circumference of the sintering plate 8 in its radial direction along the straight line. In addition, in this embodiment, it is also possible, instead of such a concentric alignment, to align a plurality of green compacts Q . . . , for example, along a plurality of straight lines passing through the center O at regular intervals in the circumferential direction so as to obtain a radial alignment or a concentric and radial alignment in plan view. Moreover, in the following drawings (FIGS. 8 to 10), the density of dots in the green compact Q, which is shown outside the sintering plate, means that of a raw material in the green compact Q. Higher the density of the dots, higher the density of the raw material in the green compact Q is.

Further, in order to place a plurality of green compacts Q . . . on the sintering plate 8, the aligning apparatus of the present invention shown in FIG. 5 may also be adopted in this embodiment. In other words, by using the aligning apparatus, the plurality of green compacts Q . . . , which are formed so that the density of the raw material powder P is decreased toward the predetermined direction, can be concentrically placed on the sintering plate 8 in plan view so that the predetermined direction R is oriented substantially toward the outer circumference of the sintering plate 8.

Figure 9:
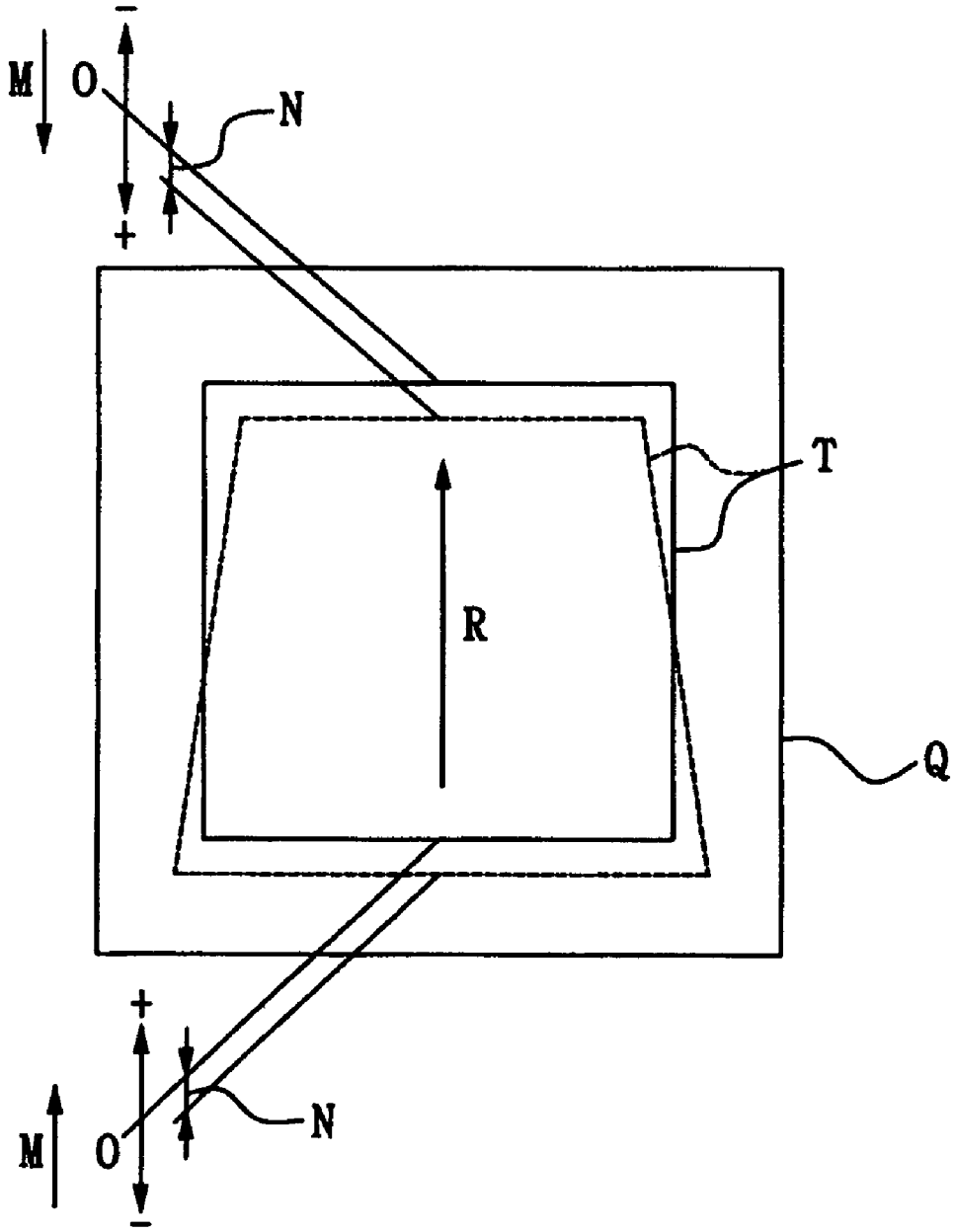
FIG. 9 is a plan view showing a green compact according to a fourth embodiment of the present invention and the shape and dimension of a throwaway tip after sintering in case the green compact is uniformly sintered.

A plurality of the sintering plates 8 on which the green compacts Q . . . are placed as described above are superposed with a suitable interval, as necessary, and then received and heated in the sintering furnace so that the green compact compacts Q . . . are sintered to form a throwaway tip. At this time, as for the manufacturing method, each green compact Q is press-formed with a density gradient of the raw material powder P decreased toward the predetermined direction R, and, as shown in FIG. 8, is placed on the sintering plate 8 so that the direction R is oriented toward the outer circumference of the sintering plate 8 in plan view, In sintering, in this embodiment, as shown in FIG. 9, infinitesimal deformation is generated in the green compact Q itself due to the density gradient thereof so that shrinkage from the green compact Q to the throwaway tip is increased toward the outer circumference of the sintering plate 8, that is, toward the direction R in plan view, as mentioned above (that is, the green compact Q is deformed so that the volume of deformation N in the shrinking direction M is increased toward the direction R as shown by the dashed line in FIG. 9). On the contrary, since the green compact Q itself is configured so that shrinkage is reduced toward the inner circumferential center of the sintering plate 8, or toward a direction opposite to the direction R, it is possible to offset the deformation caused by difference in rate of shrinkage based on the orientation of the green compact Q on the sintering plate 8 with the deformation caused by difference in rate of shrinkage based on the density gradient of the green compact Q itself. Thus, according to the throwaway tip manufacturing method described above, it is possible to correct the deformation caused by partial or fine difference in rate of shrinkage due to the orientation of the green compact Q placed on the sintering plate 8, thereby making it possible to obtain approximately G-grade accuracy even in a tip having a sintered skin without performing the grinding after the sintering. Thus, a throwaway tip of a desired shape and dimension can be manufactured with high accuracy at a low cost. Moreover, since the deformation (the portion shown by dashed line in the drawing) of the throwaway tip T after sintering, caused by difference in rate of shrinkage based on the density gradient of the green compact Q itself on the sintering plate, is extremely infinitesimal as mentioned above, length difference between two sides of the isosceles trapezoid formed by the green compact Q in plan view, is actually very small, though it is shown bigger in FIG. 9 for the purpose of illustration.

Here, in order to press-form the green compact Q so that the density is gradually decreased in the direction R toward the outer circumference of the sintering plate 8 in this embodiment, when the green compact Q is formed according to the die pressing method, the raw material powder P of the throwaway tip is filled into the cavity 4 opened in the top face 2 of the die 1 from the raw material powder feed box 7, then the filled raw material powder P is scraped by means of the raw material powder feed box 7, and then a green compact Q is press-formed with a direction opposite to the scraping direction being set as the direction R. However, in order to scrape the raw material powder P filled in the cavity 4, the raw material powder P in the vicinity of the opening of the cavity 4 are dragged toward the scraping direction, thereby increasing density. On the contrary, the density of the raw material powder P is relatively decreased in the direction opposite to the scraping direction. Thus, by sintering the green compacts Q while placed on the sintering plate 8 so that the predetermined direction R is an opposite direction to the scraping direction, it is possible to manufacture a throwaway tip with high accuracy at a low cost according to the above method without any manipulation for giving a density gradient to the green compact Q. On the other hand, in the case of giving a density gradient to the green compact Q by controlling the filling quantity of raw material powder P into the cavity 4 as mentioned above instead of or together with the above fact, it is possible to more securely press-form the green compact Q with a desired density gradient so that the density is gradually decreased in the predetermined direction R simply by scraping the raw material powder P according to characteristics of the raw material powder P or various filling conditions, even though an excess or deficiency is generated in the density gradient of the green compact Q.

Further, in this embodiment, even when the press-formed green compact Q is placed on the sintering plate 8, a plurality of the green compacts Q . . . having gradually decreased density in the direction R are radially or concentrically placed in plan view, and the green compacts Q arranged in a straight line radially extending from the center O of each concentric circle or the sintering plate 8 are arranged so that the direction R is oriented exactly toward the outer circumference of the sintering plate 8 and the direction R is radially extending from the center O toward the outer circumference in plan view of the sintering plate 8. Therefore, according to this embodiment, since each green compact Q is placed so that the direction R is exactly oriented toward the outer circumference from the inner circumferential center O of the sintering plate 8, the deformation caused by difference in rate of shrinkage based on the orientation of the green compact Q on the sintering plate 8 may be more effectively offset by difference in rate of shrinkage based on the density gradient of the green compact Q, thereby allowing manufacturing a throwaway tip with higher accuracy. Moreover, since the sintering plate 8 has a disc shape in this embodiment, in order to place a plurality of the green compacts Q . . . on the sintering plate 8 radially or concentrically, it is sufficient to set straight lines extending radially from the center O or concentric circles about the center of the center O for the arrangement of the green compacts Q . . . on the basis of the center O of the disc of the sintering plate 8. In addition, an arrangement pattern of the green compacts Q . . . on the sintering plate 8 can be easily determined.

Furthermore, in this embodiment, in order to place the green compact Q on the sintering plate 8 in such an arrangement, an aligning apparatus for aligning and placing the green compacts Q, which are press-formed so that the density is gradually decreased in the predetermined direction R, on the sintering plate 8 so that the direction R is oriented substantially toward the outer circumference of the sintering plate 8 in plan view, is used and the plurality of green compacts Q . . . can be regularly placed on the sintering plate 8 with suitable intervals in the circumferential and radial directions. Also, in this embodiment, particularly, the aligning apparatus includes a conveyance mechanism 9 for conveying the green compact Q from the die 1 toward the sintering plate 8, and a sintering plate holder 10 for horizontally holding the sintering plate 8. The sintering plate holder 10 has a rotation mechanism capable of rotating and positioning the sintering plate 8 at a predetermined angle of rotation around the center O. Thus, the green compacts Q are sequentially placed on the sintering plate 8 while they are rotated and positioned on the sintering plate 8 at a predetermined angle by means of the rotation mechanism so that the green compacts Q can be held, conveyed, placed and returned to the die 1 in short cycles by only parallel movement in vertical and horizontal directions without changing their direction R. Therefore, even though the upper and lower punches 5 and 6 or the raw material powder feed box 7 is actuated at high speed in the die 1 to press-form the green compacts Q sequentially, the aligning apparatus can be synchronized with such rapid operation. As a result, the green compact Q may be rapidly placed on the sintering plate 8 without damaging the press-forming speed, ensuring efficiency in manufacturing a throwaway tip.

Moreover, the aligning apparatus may rotate the green compact holder 11 for holding the green compact Q around its vertical axis and position it at a predetermined angle of rotation as shown by a dashed line in FIG. 5, instead of, or together with, rotating the sintering plate 8 around its center O and positioning it at a predetermined angle of rotation. Thus, it is also possible to carry the green compact Q to sequentially place it at the predetermined position on the sintering plate 8 while changing the direction R. In addition, particularly in case the green compact Q is placed on the sintering plate 8 while it is rotated as mentioned above, the sintering plate holder 10 may be horizontally moved in at least one of X and Y directions for each sintering plate 8, and the conveyance mechanism 9 may be configured to move the green compact holder 11 in one (X direction in FIG. 5) of X and Y directions. Moreover, for example, an arm of an articulated robot may be provided with the green compact holder and may be programmed to arrange and place the green compacts Q on the sintering plate 8 as described above.

By the way, the present embodiment shows that a plurality of the green compacts Q . . . is radially or concentrically placed on the disc-shaped sintering plate 8 in plan view, as described above. However, similar to the second and third embodiments, the plurality of green compacts Q . . . are placed on the sintering plates 8 and 12 in a lattice or zigzag pattern in plan view, as in a fifth embodiment shown in FIG. 10 or a sixth embodiment shown in FIG. 11, and then the plurality of green compacts Q . . . are divided into a plurality of green compact groups A to D (four groups in the fifth and sixth embodiments) respectively extending from the inner circumferential center to the outer circumference of the sintering plates 8 and 12 in plan view so that the directions R of the green compacts Q in the same green compact groups A to D are made parallel. Thus, the green compacts Q may be placed so that the direction R in which the density of each green compact Q is decreased is oriented substantially toward the outer circumference of the sintering plates 8 and 12.

Among them, in the fifth embodiment, as described above, the green compacts Q . . . press-formed in a substantially square plate shape, similar to that in the fourth embodiment are placed on the sintering plate 8 having the same disc shape as that in the fourth embodiment, in a lattice pattern so that each side of the square formed by the upper and lower surfaces of the green compact is parallel to a pair of diametrical lines L and L orthogonal to each other at the center O of the disc formed by the sintering plate 8, or so as to have regular intervals in directions of the diametrical lines L and L. Also, the plurality of green compact groups A to D are composed of the green compacts Q . . . respectively placed on four sectors extending from the center O toward the outer circumference and divided by these diametrical lines L and L, and the green compacts Q in each green compact group A to D are arranged so that the directions R of the green compacts Q are made parallel to each other and are oriented substantially toward the outer circumference of the sintering plate 8.

Figure 10:
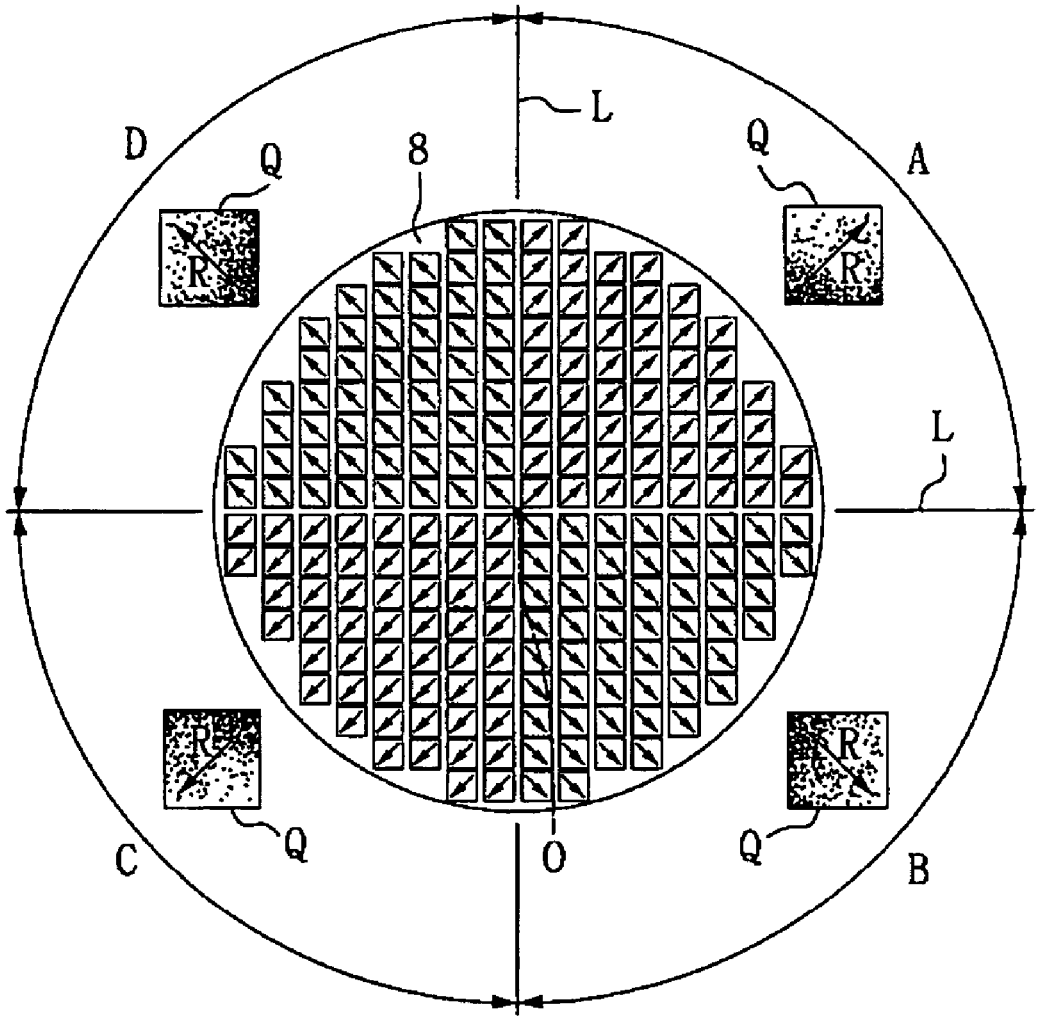
FIG. 10 is a plan view showing the arrangement of green compacts on a sintering plate according to a fifth embodiment of the present invention, and an enlarged plan view showing a direction in which the density of each green compact which composes green compact groups A to D is decreased, using the arrow R outside the sintering plate.

Here, the predetermined direction R in the fifth embodiment that the density of each green compact Q is decreased is not a direction toward a side vertically opposite to one side of the square formed by the upper and lower surfaces of the green compact Q as in the fourth embodiment, but a direction oriented from one corner of the square toward an opposite corner along a diagonal line passing through the corner, as in the green compacts Q enlarged in such a manner to correspond to the respective green compact groups A to D outside the sintering plate 8 in FIG. 10. The directions R of all green compacts Q . . . composing the same green compact groups A to D divided by the pair of diametrical lines L and L interposed between the sectors of the green compact groups A to D are all made parallel. In addition, in order to press-form the green compacts Q having density gradients in the diagonal direction R of the square formed by the upper and lower surfaces with the use of the die 1 as shown in FIGS. 1 and 2, as shown by a dashed line in FIG. 1 for example, the cavity 4 itself formed in the die body 3 is formed so that the diagonal line of the square in plan view of the green compact Q to be press-formed conforms to the scraping direction of the raw material powder feed box 7, and the predetermined direction R becomes a direction oriented opposite to the scraping direction along the diagonal line. In other case, instead of or together with the fact, the filling quantity of the raw material powder P into the cavity 4 is controlled in a direction, which will be selected as the predetermined direction R, so that the green compacts Q of the respective green compact groups A to D are placed on the sintering plate 8 with the predetermined direction R being oriented substantially toward the outer circumference of the sintering plate 8. Moreover, in this embodiment, the arrangement of the green compacts Q . . . in the respective green compact groups A to D is rotatably symmetrical by an included angle (90° in this embodiment) formed by the diametrical lines L and L adjacent to each other in the circumferential direction about the center O. In other words, when the sintering plate 8 is rotated by the included angle about the center O, arrangement and direction R of the green compacts Q . . . in the respective green compact groups A to D become coincided.

Figure 11:
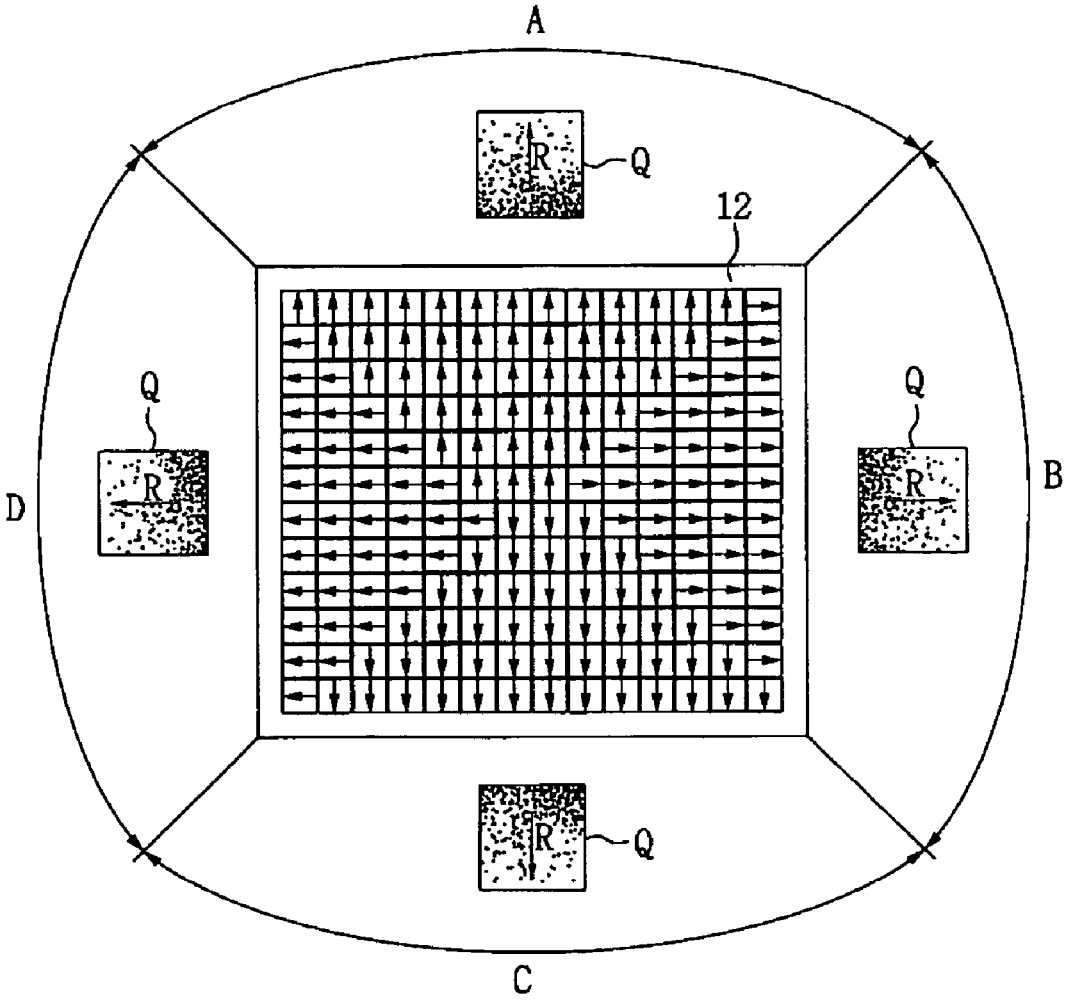
FIG. 11 is a plan view showing the arrangement of green compacts on a sintering plate according to a sixth embodiment of the present invention, and an enlarged plan view showing a direction in which the density of the each green compact which composes green compact groups A to D is decreased, using the arrow R outside the sintering plate.

In addition, in the sixth embodiment shown in FIG. 11, as mentioned above, a plurality of green compacts Q . . . having a square plate shape are arranged on the sintering plate 12 having a rectangular plate shape in a lattice pattern at regular intervals in long and short side directions so that each side of the square forming the upper and lower surfaces is parallel to long and short sides of the rectangle formed by the sintering plate 12 in plan view. The green compacts Q . . . are substantially divided by a pair of diagonal lines of the rectangle formed by the sintering plate 12, thereby forming a plurality of green compact groups A to D (four groups in this embodiment) having a substantially isosceles triangle respectively extending from the inner circumferential center of the sintering plate 12 toward the outer circumference thereof in plan view. Here, the division of these green compact groups A to D does not strictly obey the diagonal lines of the rectangle formed by the sintering plate 12, but corresponds to the isosceles triangles, substantially divided by the diagonal lines, whose base line is the long or short side of the rectangle, as shown in FIG. 11. Also, in this embodiment, the green compact Q is configured so that a direction oriented from a side of the square formed by their upper and lower surfaces in plan view, toward opposite side perpendicularly opposite to the side is the predetermined direction R, with a density gradient that density is gradually decreased in the direction R, similar to the fourth embodiment. The green compacts Q are placed so that the directions R in the respective green compact groups A to D are parallel to a direction oriented toward the outer circumference of the sintering plate 12, perpendicular to the base line of the isosceles triangle formed by the corresponding green compact groups A to D, that is, perpendicular to the long and short sides of the rectangle formed by the sintering plate 12, as in the green compacts Q enlarged in such a manner to correspond to each green compact group A to D outside the sintering plate 12 in FIG. 11.

Thus, by receiving into the sintering furnace the sintering plates 8 and 12 on which the green compacts Q are placed so that the predetermined direction R that its density is decreased as above is oriented substantially toward the outer circumference, and sintering the green compacts Q thereon, it is possible to offset the deformation caused by difference in rate of shrinkage based on the orientation of the green compacts Q on the sintering plates 8 and 12 with difference in rate of shrinkage based on the density gradient of the green compacts Q, even in the fifth and sixth embodiments, thereby allowing manufacturing a throwaway tip with high accuracy. Also, since the plurality of green compacts Q . . . are placed on the sintering plates 8 and 12 in a lattice pattern in the fifth and sixth embodiments, it is possible to prevent that adjacent green compacts Q are spaced apart more than required, thereby allowing densely arranging the green compacts Q on the sintering plates 8 and 12. In other words, the number of green compacts Q capable of being placed on one sintering plate 8 and 12 can be increased, and the efficiency of manufacturing a throwaway tip can be improved by receiving and sintering the more number of green compacts Q in the sintering furnace at one time. In addition, the plurality of green compacts Q . . . is arranged in series for both lateral and longitudinal directions in plan view, in the fifth and sixth embodiments so that the green compacts Q have a lattice pattern. However, the green compacts Q may be arranged in a zigzag pattern by placing green compacts Q between two adjacent rows (either lateral or longitudinal) aside in a direction in which the row is extended.

Further, similar to the first and second embodiments, the aligning apparatus shown in FIG. 5 may be adopted in the fifth and sixth embodiments. In other words, in order to form the plurality of green compact groups A to D linearly extending from the center O of the sintering plate 8 toward the outer circumference by placing the plurality of green compacts Q . . . on the sintering plate 8 having a disc shape in a lattice pattern so that the directions R are parallel to each other as in the fifth embodiment, the sintering plate 8 is first positioned, and then the green compacts Q are sequentially conveyed by the conveyance mechanism 9 from the die 1 without changing the directions R so as to be placed on a portion surrounded by the diametrical lines L and L of the sintering plate 8 in a lattice pattern. Thus, the first green compact group A composed of a plurality of green compacts Q with the directions R being parallel to each other is formed, and the sintering plate 8 is rotated by a predetermined angle (90° in the fifth embodiment) around the center O and positioned by means of the rotation mechanism, and the green compacts Q are sequentially conveyed and placed on the sintering plate 8 in a lattice pattern in the same way, and then the second green compact group B is formed in the same way. Similarly, such processes are repeated to form the third and fourth green compact groups C and D. Here, since the arrangement of the green compacts Q in the respective green compact groups A to D becomes rotatably symmetrical by 90° around the center O in the fifth embodiment, the green compacts Q may be placed in the same arrangement pattern when forming the respective green compact groups A to D. In addition, in the sixth embodiment, though the green compact groups A and C have an arrangement pattern different from the green compact groups B and D, the green compacts Q . . . are placed in a lattice pattern with the directions R being parallel to each other as in the fifth embodiment while the sintering plate 12 of a rectangular plate shape is rotated and positioned by a predetermined angle (90° in the sixth embodiment) around the center where the diagonal lines of the rectangle are crossed, thereby forming the green compact groups A to D sequentially.

By the way, in the fourth to sixth embodiments, the green compact Q is press-formed so that the density is gradually decreased in the predetermined direction R, and the green compact Q is placed so that the direction R is oriented toward the outer circumference of the sintering plates 8 and 12, thereby offsetting the infinitesimal deformation in sintering caused by difference in rate of shrinkage based on the orientation of the green compact Q to manufacture a throwaway tip of a desired shape and dimension. Thus, the green compact Q is formed in a shape similar to the throwaway tip to be manufactured. Besides this method, it is also possible to manufacture a throwaway tip having a desired shape and dimension by forming the green compact into an estimated shape and dimension which have estimated the infinitesimal deformation in sintering according to the orientation of the green compact. In other words, though the rate of shrinkage at a portion of the green compact oriented toward the outer circumference of the sintering plate is smaller than that of a portion oriented toward the inner circumferential center, it is possible to obtain a throwaway tip of a desired shape and dimension with high accuracy after sintering by forming the shape and dimension of the green compact for the shape and dimension of the throwaway tip after sintering in consideration of difference in rate of shrinkage so that the dimension difference is large at the portion toward the inner circumferential center of the sintering plate where the rate of shrinkage is greater, whereas the dimension difference is smaller at the portion toward the outer circumference where the shrinkage is low.

Thus, for example, if the infinitesimal deformation of the throwaway tip after sintering is not sufficiently offset only by press-forming the green compact Q so that the density is gradually decreased toward the direction R in the fourth to sixth embodiments, it is also possible to form the green compact Q into a shape and dimension that the dimension difference between the green compact and the throwaway tip after sintering is gradually decreased toward the predetermined direction R, and then to place the green compact Q so that the direction R is oriented substantially toward the outer circumference of the sintering plates 8 and 12 in plan view, as in the first to third embodiments.

In other words, in this case, for example, the green compact Q has a substantially isosceles trapezoid shape in plan view, in which one side in the direction R is shorter than its opposite side, and is press-formed so that density is gradually decreased toward the direction R as shown in FIG. 3, and then a plurality of such green compacts Q . . . are placed concentrically so that the directions R are oriented toward the outer circumference of the sintering plate 8 having a disc shape, as shown in FIG. 4. Alternatively, for example, as shown in FIG. 6, the green compact Q is press-formed so that the density is gradually decreased in the direction R oriented from one corner through a diagonal line passing through the corner toward its opposite corner in plan view, and have a shape and dimension in which the dimension difference S between the green compact and the throwaway tip T after sintering is gradually decreased toward the direction R in plan view, and then are placed on the sintering plate 8 having a disc shape in a lattice pattern and divided into a plurality of green compact groups A to D extending from the inner circumferential center of the sintering plate 8 toward the outer circumference thereof, so that the directions R are made parallel to each other and are oriented toward the outer circumference of the sintering plate 8 in the respective green compact groups A to D. Alternatively, for example, the green compact Q has a substantially isosceles trapezoid shape in which one side in the direction R is shorter than its opposite side as shown in FIG. 3, and is then press-formed so that the density is gradually decreased toward the direction R, and then a plurality of green compacts Q . . . are placed and arranged in a lattice pattern on the sintering plate 12 having a rectangular plate shape as shown in FIG. 7, for example. In addition, even in the case that the green compact Q having an isosceles trapezoidal plate shape or an inclined quadrangle shape, in plan view, is press-formed, the cavity 4 of the die 1 is designed to conform to such shapes, and then the direction oriented in an opposite direction to the direction R of these shapes along the diagonal line of the inclined quadrangle is set as the scraping direction by the raw material powder feed box 7, or the filling quantity of the raw material powder P into the cavity 4 is controlled in the direction, which is set as the predetermined direction R.

In the embodiment in which the density of the green compact Q is gradually decreased toward the direction R oriented substantially toward the outer circumference of the sintering plates 8 and 12 and the dimension difference S between the green compact and the throwaway tip T after sintering is small, it is possible to correct the infinitesimal deformation caused by difference in rate of shrinkage based on the orientation of the green compact Q on the sintering plates 8 and 12 by means of the density gradient given to the green compact Q as mentioned above, and to correct the shape and dimension of the green compact Q itself so as to make the infinitesimal deformation into a previously estimated shape and dimension. In other words, since the green compact Q is deformed for a shape of the throwaway tip T after sintering in advance so that the dimension difference S between the green compact and the throwaway tip T after sintering is decreased at a portion of the green compact Q oriented toward the outer circumference of the sintering plates 8 and 12 where rate of shrinkage is small, while the dimension difference S is increased at a portion of the green compact Q oriented toward the inner circumferential center of the sintering plates 8 and 12 where rate of shrinkage is large, thereby offsetting the infinitesimal deformation caused by partial difference in rate of shrinkage due to the orientation of the green compact Q on the sintering plates 8 and 12, it is possible to manufacture a throwaway tip T of a desired shape and dimension after sintering with high accuracy. Thus, according to these embodiments, even in the case that it is impossible to offset the infinitesimal deformation caused by difference in rate of shrinkage up to a necessary accuracy level by, for example, giving a density gradient to the green compacts Q, it is possible to obtain a throwaway tip T with high accuracy even in the case of having a sintered skin.

In addition, though the present invention is subjected to manufacture a throwaway tip T with high accuracy even in the state of sintered skin, it is also possible to scheme more improvement in accuracy since the throwaway tip T before grinding has high accuracy in the case of performing peripheral grinding to the throwaway tip T after sintering. In addition, even in the case of applying various coating processes on the surface of the throwaway tip T, the shape and dimension of the throwaway tip T can be kept with high accuracy after coating. On the other hand, though the above embodiments are all described about the case of manufacturing a throwaway tip T having a substantially square plate shape, the present invention can be applied to manufacturing a throwaway tip having other shapes, such as a triangular plate shape or a lozenge-formed plate shape. Moreover, though the above embodiments are described about the case of manufacturing a throwaway tip T made of cemented carbide mainly containing WC (tungsten carbide), the present invention can be applied to manufacturing a throwaway tip made of other materials, such as cermet or ceramic, according to the powder metallurgy.

EXAMPLES

Now, advantages of the present invention will be demonstrated by way of specific examples of the present invention.

In this example, on the basis of the first embodiment, a green compact Q was obtained by press-forming raw material powder P made of cemented carbide, in the P30 group on the basis of ISO usage classification symbol, to be sintered into a throwaway tip T having a shape and dimension equivalent to SEMT13T3 in JIS B 4120-1998, into an isosceles trapezoidal plate shape so that dimension difference between the green compact and the throwaway tip T after sintering is decreased toward the direction R. A plurality of the green compacts were placed on the sintering plate 8 having a disc shape with a diameter of 400 mm in a shape of concentric circles so that the direction R is oriented toward the outer circumference of the sintering plate 8 as shown in FIG. 4. Then, the green compacts Q are received and sintered in the sintering furnace. This is defined as Example 1. In addition, for the purpose of comparison, a green compact Q made of the same raw material powder P to be sintered in the same dimension and the same shape as Example 1 is press-formed into a square plate shape, and a plurality of the green compacts Q are placed on the disc-shaped sintering plate 8 having the same diameter of 400 mm so as to form a lattice pattern as shown in FIG. 6 from the same direction without rotating the sintering plate 8, and then the green compacts Q are received and sintered in the sintering furnace under the same condition as Example 1. This is defined as Comparative Example 1.

Moreover, as Example 2, according to the third embodiment, a plurality of green compacts Q manufactured by press-forming, in an isosceles trapezoid shape, raw material powder P made of cermet, in the P30 group on the basis of ISO usage classification, to be sintered into a throwaway tip T having a square plate shape as in Example 1 were placed on the sintering plate 12 having a rectangular plate shape of 300 mm×400 mm in a lattice pattern so that a plurality of green compact groups A to D are formed with the directions R being parallel to each other and oriented substantially toward the outer circumference of the sintering plate 12 as shown in FIG. 7, and were sintered. In addition, as Comparative Example 2 for Example 2, a green compact Q manufactured by press-forming raw material powder P made of cermet in the P30 group on the basis of the ISO usage classification and having a square plate shape as in Comparative Example 1 was placed on the sintering plate 12 as in Example 2 in a lattice pattern from the same direction without rotating the sintering plate 12 by the same number, and was sintered.

Figure 12:
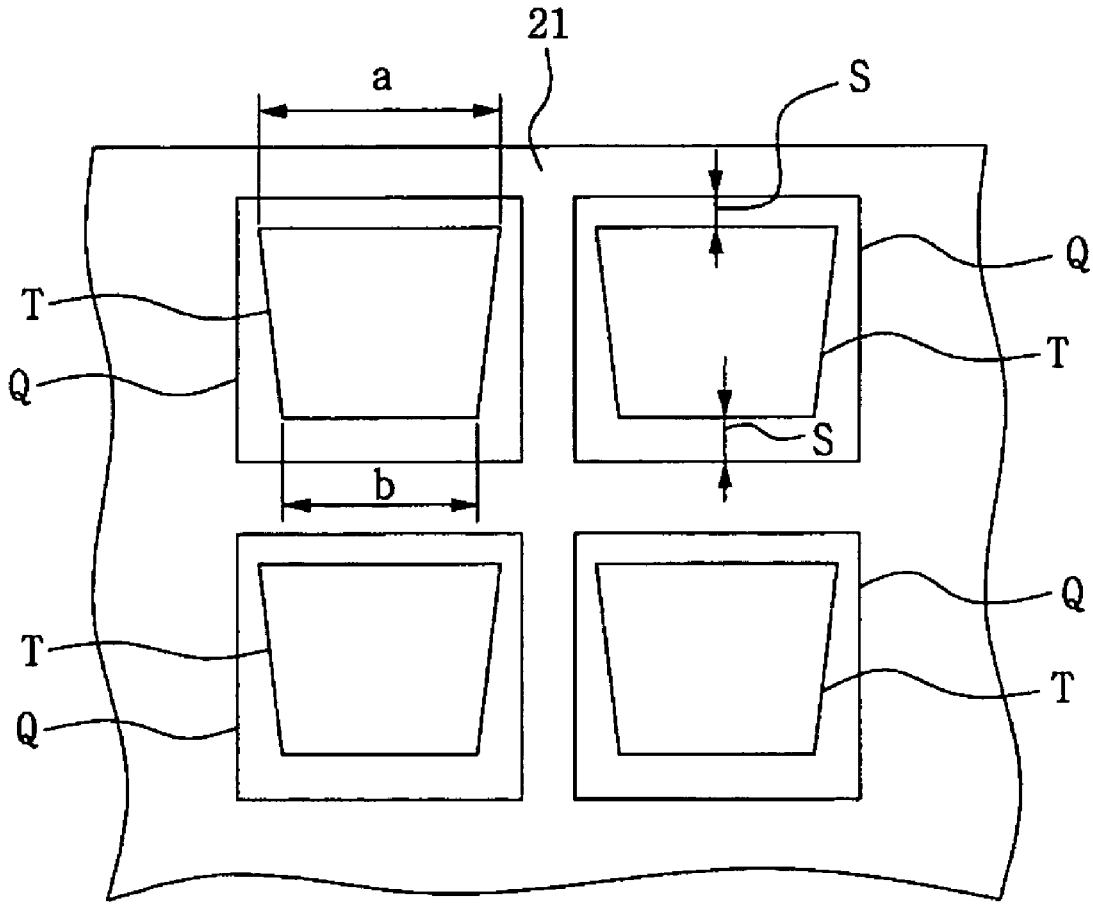
FIG. 12 is an enlarged plan view showing infinitesimal deformation from the green compact to the throwaway tip in the conventional manufacturing method.

As mentioned above, for the throwaway tips T in a state of sintered skin after sintering, manufactured by Examples 1 and 2 and Comparative Examples 1 and 2, the size of the infinitesimal deformation was measured as a maximum value of a length difference between two opposite sides of the square formed by the top face of each throwaway tip T (a-b in FIG. 12). As a result of the measurement, Comparative Examples 1 and 2 in which the green compacts Q are formed into a square plate shape give only maximum values of the volume of deformation of 0.075 mm and 0.086 mm respectively together with only M-grade accuracy, whereas Example 1 in which the green compacts Q are concentrically placed with the direction R being oriented toward the outer circumference may obtain a maximum value of the volume of deformation of 0.020 mm together with the aforementioned approximately G-grade accuracy and Example 2 with the direction R being oriented substantially toward the outer circumference may obtain accuracy of 0.033 mm, In addition, on the basis of the fourth and fifth embodiment, a green compact Q were obtained by press-forming raw material powder P made of cemented carbide, in the P30 group on the basis of ISO usage classification symbol, to be sintered into a throwaway tip T having a shape and dimension equivalent to SEMT13T3 in JIS B 4120-1998 into a square plate shape so that the density is decreased toward the direction R. A plurality of the green compacts were placed on the sintering plate 8 having a disc shape with a diameter of 400 mm in a shape of concentric circles so that the direction R is oriented toward the outer circumference of the sintering plate 8 as shown in FIG. 8 or in a lattice pattern so that a plurality of green compact groups A to D divided to make the directions R substantially parallel to each other and oriented toward the outer circumference of the sintering plate 8 as shown in FIG. 10 are formed. Then, the green compacts Q are received and sintered in the sintering furnace.

They are respectively defined as Examples 3 and 4. In addition, for the purpose of comparison, a green compact Q made of the same raw material powder P sintered in the same dimension and the same shape as Examples 3 and 4 is press-formed into a square plate shape, and a plurality of the green compacts Q are placed on the disc-shaped sintering plate 8 having the same diameter of 400 mm so as to form a lattice pattern as shown in FIG. 10 from the same direction without rotating the sintering plate 8, and then the green compacts Q are received and sintered in the sintering furnace under the same condition as Examples 3 and 4. This is defined as Comparative Example 3.

For the throwaways tip T in a state of sintered skin after sintering, manufactured by Examples 3 and 4 and Comparative Example, the size of the infinitesimal deformation was measured as a maximum value of a length difference of two opposite sides of the square formed by the top face of each throwaway tip T (a-b in FIG. 12). As a result of the measurement, Comparative Example 3 obtained only a maximum value of the volume of deformation of 0.075 mm together with only M-grade accuracy, whereas Example 3 in which the green compacts Q were concentrically placed with the directions R being oriented toward the outer circumference may obtain a maximum value of the volume of deformation having 0.018 mm together with approximately G-grade accuracy and Example 4 with the direction R being oriented substantially toward the outer circumference may obtain a maximum value of 0.025 mm together with the aforementioned approximately G-grade accuracy.

What is claimed is:

1. A method of simultaneously making a plurality of sintered articles for throwaway tips of an accuracy of at least M-grade accuracy from green compacts, said method comprising the steps of:

filling raw material powder into a cavity formed in a die;

press forming said raw material powder to form a plurality of green compacts, placing said green compacts on a sintering plate having a center; and sintering said green compacts simultaneously to form said sintered articles, wherein each of said green compacts is formed having at least one of a density gradient or a dimensional gradient, said at least one gradient decreasing in a predetermined direction across said green compact, and wherein each of said green compacts is substantially oriented on said sintering plate in plan view with said gradient decreasing outwardly from the center of said sintering plate.

2. A method as defined in claim 1, wherein said accuracy is approximately G-grade accuracy.

3. A method as defined in claim 1, wherein said green compacts are placed radially on said sintering plate with respect to the center of said sintering plate as a result of the placing step.

4. A method as defined in claim 1, wherein said green compacts are placed concentrically on said sintering plate with respect to the center of said sintering plate as a result of the placing step.

5. A method as defined in claim 1, wherein a lower punch is provided in the cavity having an opening in the top face of the die to move vertically relative to the die; and wherein a raw material powder feed box above the top face of the die moves across the top face, to supply raw material powder to fill the cavity while the lower punch is vertically moved so that the filling quantity of the raw material powder is controlled.

6. A method as defined in claim 1, wherein an upper portion of the filled raw material powder is scraped from the die.

7. A method of simultaneously making a plurality of sintered articles for throwaway tips of an accuracy of at least M-grade accuracy from green compacts, said method comprising the steps of:

filling raw material powder into a cavity formed in a die;

press forming said raw material powder to form a plurality of green compacts;

placing said green compacts on a sintering plate; and sintering said green compacts simultaneously to form said sintered articles;

wherein each of said green compacts is formed having at least one of a density gradient or a dimensional gradient, said at least one gradient decreasing in a predetermined direction across said green compact wherein each of said green compacts is substantially oriented on said sintering plate in plan view with said gradient decreasing outwardly from the center of said sintering plate, and wherein a plurality of said green compacts are divided into a plurality of green compact groups respectively extending from the center of said sintering plate toward the outer circumference thereof in plan view.

8. A method as defined in claim 7, wherein said accuracy is approximately G-grade accuracy.

9. A method as defined in claim 7, wherein the plurality of green compacts is divided into four groups.

10. A method as defined in claim 7, wherein the green compacts in each green compact group are placed parallel to each other as a result of the placing step.

11. A method as defined in claim 7, wherein the plurality of green compacts are placed on the sintering plate in a lattice shape in plan view as a result of the placing step.

12. A method as defined in claim 7, wherein the plurality of green compacts are placed on the sintering plate in zigzag shape in plan view as a result of the placing step.

13. A method as defined in claim 7, wherein a lower punch is provided in the cavity having an opening in the top face of the die to move vertically relative to the die; and wherein a raw material powder feed box above the top face of the die moves across the top face, to supply raw material powder to fill the cavity while the lower punch is vertically moved so that the filling quantity of the raw material powder is controlled.

14. A method as defined in claim 7, wherein an upper portion of the filled raw material powder is scraped from the die.

15. A method as defined in claim 1, wherein said green compacts each have an identical decreasing gradient across the green compact.

16. A method as defined in claim 7, wherein said green compacts each have an identical decreasing gradient across the green compact.

17. An apparatus for aligning a plurality of green compacts, comprising:

a sintering plate holder for horizontally holding a sintering plate; and a conveyance mechanism for holding and conveying the plurality of green compacts to be placed on said sintering plate, wherein said sintering plate holder has a first rotation mechanism for rotating and positioning said sintering plate at each angle of rotation around its vertical axis, and wherein said green compact is placed on said sintering plate, so that said green compact is substantially oriented on said sintering plate in plan view outwardly from the center of said sintering plate.

18. An apparatus for manufacturing throwaway tips, the apparatus comprising:

a plurality of green compacts;

a sintering plate; and an alignment apparatus including:

a sintering plate holder for horizontally holding a the sintering plate; and a conveyance mechanism for holding and conveying the plurality of green compacts to be placed on said sintering plate, wherein said sintering plate holder has a first rotation mechanism for rotating and positioning said sintering plate at each angle of rotation around its vertical axis, wherein each of said plurality of green compacts is placed on said sintering plate, and is substantially oriented on said sintering plate in plan view outwardly from the center of said sintering plate, wherein each of said green compacts is formed having at least one of a density gradient or a dimensional gradient, said at least one gradient decreasing in a predetermined direction across said green compact, and wherein each of said green compacts is oriented on said sintering plate in plan view with said gradient decreasing outwardly from the center of said sintering plate.

19. The apparatus as defined in claim 18, wherein said plurality of green compacts placed on the sintering plate are divided into a plurality of green compact groups respectively extending from an inner circumferential center of the sintering plate to the outer circumference thereof in plan view.

20. An apparatus as defined in claim 19, wherein said plurality of green compacts is divided into four groups.

21. An apparatus as defined in claim 19, wherein green compacts in the same green compact group are placed parallel to each other.

22. An apparatus as defined in claim 19, wherein said plurality of green compacts are placed on said sintering plate in a lattice shape in plan view.

23. An apparatus as defined in claim 19, wherein said plurality of green compacts are placed on said sintering plate in a zigzag shape in plan view.

24. The apparatus as defined in claim 18, wherein said plurality of green compacts are radially or concentrically placed on the sintering plate in plan view.

25. The apparatus as defined in claim 17, wherein said conveyance mechanism has a second rotation mechanism for rotating each held green compact around an axis of the conveyance mechanism.

* * * * *